US005769038A

United States Patent [19]

Takahashi et al.

[11] Patent Number: 5,769,038

[45] Date of Patent: Jun. 23, 1998

[54] LIQUID COOLING SYSTEM FOR ENGINE

[75] Inventors: Masanori Takahashi; Hiroshi Oishi, both of Hamamatsu, Japan

[73] Assignee: Sanshin Kogyo Kabushiki Kaisha, Hamamatsu, Japan

[21] Appl. No.: 814,216

[22] Filed: Mar. 11, 1997

[30] Foreign Application Priority Data

Mar. 11, 1996 [JP] Japan ..... 8-082007
Mar. 21, 1996 [JP] Japan ..... 8-089923

[51] Int. Cl.[6] ..... F02F 1/40; F02F 1/38

[52] U.S. Cl. ..... 123/41.82 R; 123/41.74; 60/321

[58] Field of Search ..... 123/41.82 R, 41.74, 123/41.75, 195 P, 196 W; 440/88, 89; 60/320, 321

[56] References Cited

U.S. PATENT DOCUMENTS

| | | | |
|---|---|---|---|
| 1,877,051 | 9/1932 | Read | 123/41.82 |
| 3,358,654 | 12/1967 | Shanahan et al. | 60/321 |
| 3,431,882 | 3/1969 | Irgens . | |
| 4,312,304 | 1/1982 | Tyner | 123/41.74 |
| 4,377,990 | 3/1983 | Seidl | 123/41.74 |
| 4,399,797 | 8/1983 | Iwai . | |
| 4,452,194 | 6/1984 | Watanabe . | |
| 4,545,332 | 10/1985 | Suzuki et al. . | |
| 4,588,385 | 5/1986 | Suzuki et al. . | |
| 4,953,525 | 9/1990 | Sakurai et al. . | |
| 4,991,546 | 2/1991 | Yoshimura . | |
| 5,036,804 | 8/1991 | Shibata . | |
| 5,048,467 | 9/1991 | Kojima . | |
| 5,251,577 | 10/1993 | Kojima . | |
| 5,537,958 | 7/1996 | Nishimura et al. . | |
| 5,555,855 | 9/1996 | Takahashi . | |

FOREIGN PATENT DOCUMENTS 2055422 3/1981 United Kingdom .

*Primary Examiner*—Erick R. Solis
*Attorney, Agent, or Firm*—Knobbe, Martens, Olson & Bear LLP

[57] ABSTRACT

A liquid cooling arrangement for an internal combustion engine having a cylinder block with a cylinder head connected thereto and defining at least one combustion chamber, a common exhaust passage extending through the cylinder block and an exhaust passage leading from each combustion chamber to the common exhaust passage, is disclosed. The liquid cooling arrangement includes a pump for pumping cooling liquid from a cooling liquid source first through at least one passage extending through the cylinder head generally adjacent the exhaust passages leading from the combustion chambers, and through at least one passage extending through the cylinder block generally adjacent the common exhaust passage. Once the cooling liquid has passed through these passages, the cooling liquid is delivered to one or more passages extending through the cylinder head or block generally adjacent the combustion chamber (s). The cooling liquid then selectively passes a thermostat into a cooling liquid return line through which the cooling liquid is drained from the engine.

20 Claims, 19 Drawing Sheets

LIQUID COOLING SYSTEM FOR ENGINE

FIELD OF THE INVENTION

The present invention relates to a cooling system for an internal combustion engine. In particular, the present invention relates to a liquid cooling system for an internal combustion engine having a number of coolant passages therethrough.

BACKGROUND OF THE INVENTION

Watercraft are often powered by outboard motors positioned at the stern of the craft. These motors have an internal combustion engine positioned within a cowling of the motor. For among other reasons, because the outboard motor is positioned at the stern of the craft, and because the motor is tiltable, it is desirable to keep the engine's size and weight to a minimum.

In order to keep the engine small, its various parts are typically mounted much closer to one another than might be the case with similar types of engines utilized in other settings. One problem which arises with these engines relates to keeping various of the components of the engine cool when they are so close to one another. The cooling problem is further aggravated by the fact that the engine is positioned within an enclosed cowling, trapping the heat therein.

It is especially important that the combustion chambers be cooled adequately, and be isolated from heat transfer from other portions of the engine. If the combustion chambers become too hot, the combustion efficiency is greatly reduced, lessening engine power output. In addition, if the combustion chambers become too hot, the lubricating oil may be scorched and burned, reducing its effectiveness. The cylinder walls, pistons or rings may also be warped or damaged.

Liquid cooling systems are commonly utilized to cool the engine. These cooling systems circulate liquid coolant throughout the cylinder block, cylinder head(s) and about the exhaust manifold(s) to cool them. An example of the liquid coolant flow path utilized with an engine having a cylinder block, cylinder head connected thereto, and an exhaust manifold for routing exhaust gases from the combustion chambers of the engine, is illustrated in FIG. 11.

In accordance with the prior art liquid cooling arrangement, the coolant from a source is divided, some being routed directly to cooling passages in the cylinder block, while other coolant is first diverted through passages extending about the exhaust passages. This arrangement has the disadvantage that the temperature profile of the engine varies significantly. For example, some very cool coolant is delivered directly to passages which cool a portion of the combustion chambers within the cylinder block, while other coolant which has already passed through the cylinder head adjacent the exhaust passages is routed to cool a portion of the combustion chambers in the cylinder block as well. This may cause some areas of the cylinder block to be cooled greatly, while other areas are cooled much less. This thermal distribution may result in warping of the cylinder block, causing the combustion chambers to become irregularly shaped.

The prior art cooling arrangements also provide for allowing the coolant within one or more portions of the engine to heat up along with the engine. Once the engine and coolant is hot, cold cooling liquid is introduced into the system. This may result in the introduction of very cool water in a hot portion of the engine, again resulting in thermal stresses.

A liquid cooling arrangement for an internal combustion engine which overcomes the problems associated with the prior art, and provides effective and efficient cooling, is desirable.

SUMMARY OF THE INVENTION

A liquid cooling arrangement is provided for an internal combustion engine. Preferably, the engine is of the type having a cylinder block with at least one cylinder head connected thereto and defining at least one combustion chamber. A common exhaust passage extends through the cylinder block. An exhaust passage extends from each combustion chamber to the common exhaust passage.

In accordance with the present invention, the liquid cooling arrangement includes at least one first cooling passage extending through the cylinder head generally adjacent the exhaust passages extending from the combustion chambers for cooling the cylinder head. At least one second cooling passage is provided which extends through the cylinder block generally adjacent the common exhaust passage. Lastly, one or more combustion chamber cooling passages are provided in the cylinder head and/or cylinder block generally adjacent the combustion chamber(s) for cooling the combustion chamber(s).

Means, preferably in the form of a coolant pump, are provided for pumping cooling liquid through the at least one first passage, then through the at least one second passage, and then through the combustion chamber cooling passages. Alternatively, the cooling liquid is pumped through the at least one second passage, then the at least one first passage, and then through the combustion chamber cooling passages.

Preferably, the cooling system includes at least one thermostat for controlling the flow of cooling liquid from the engine through a cooling liquid drain line. In addition, the cooling system preferably includes at least one pressure valve positioned along the cooling liquid flow path before the coolant enters the combustion chamber cooling passages for diverting cooling liquid from the engine in the event the pressure therein exceeds a predetermined high pressure.

Advantageously, because all of the cooling liquid is routed through the first and second passages before it reaches the combustion chamber cooling passages, there is very little temperature variation in the cooling liquid when it reaches the combustion chamber cooling passages. In addition, this arrangement prevents relatively cold cooling liquid from reaching the combustion chamber cooling passages when the engine is hot, because the coolant all must first pass through passages adjacent the exhaust passages first.

In addition, the liquid cooling arrangement remains efficient in cooling the engine, preventing damage thereto. At the same time, the cooling arrangement allows the engine to remain compact, such as for use in an outboard motor application.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor 20 having an engine 22 with an exhaust manifold cooling arrangement in accordance with the present invention.

Figure 1:
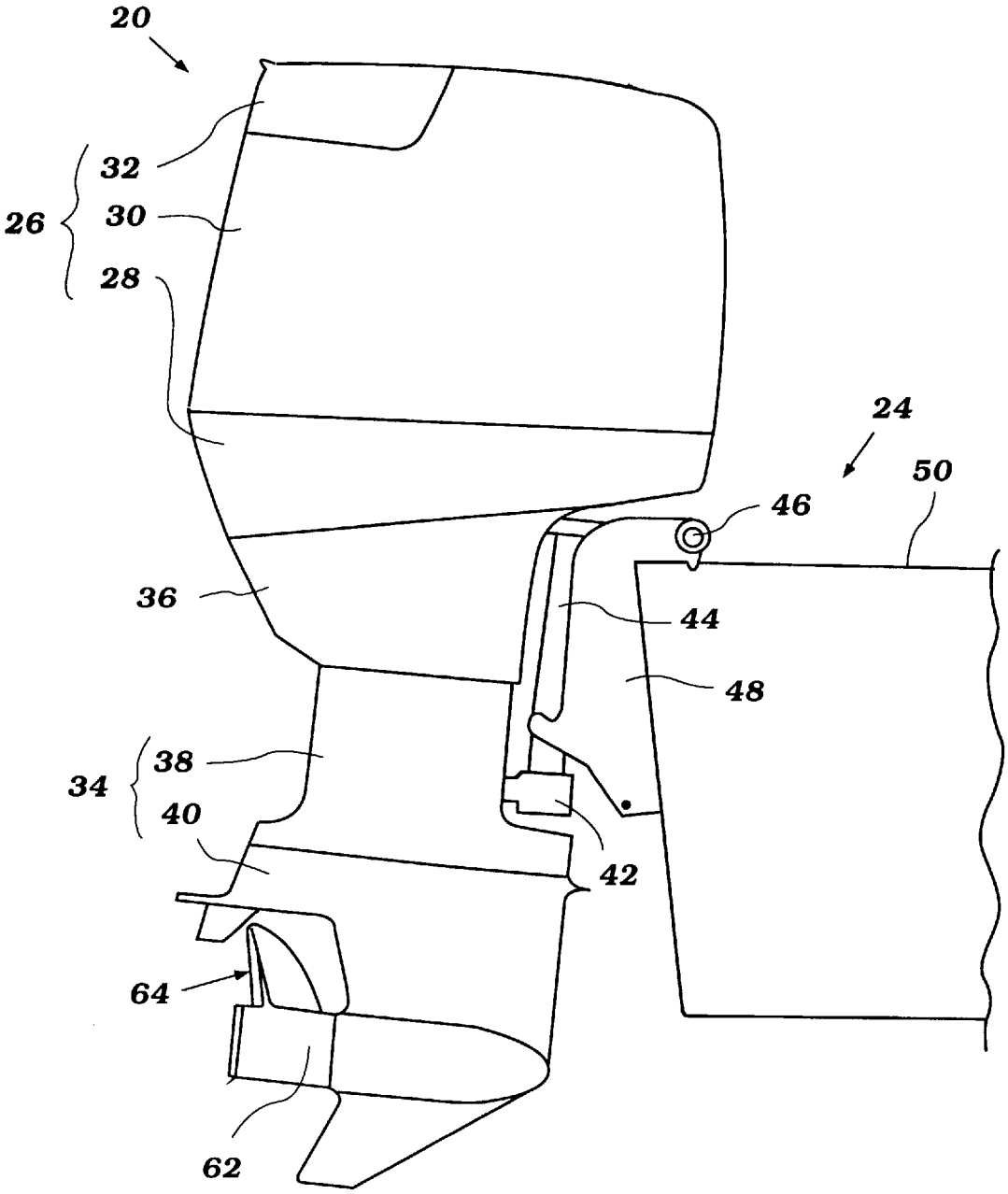
FIG. 1 is a side view of an outboard motor connected to a hull of a watercraft for powering the watercraft.

As best illustrated in FIG. 1, the outboard motor 20 is utilized to power a watercraft 24. The outboard motor 20 has a powerhead area 26 comprised of a lower tray portion 28 and a main cowling portion 30. An air inlet or vent 32 is provided in the main cowling portion 30 for providing air to an engine therein, as described in more detail below. The motor 20 includes a lower unit 34 extending downwardly therefrom, with an apron 36 providing a transition between the powerhead 26 and the lower unit 34. The lower unit 34 comprises an upper or "drive shaft housing" section 38 and a lower section 40.

A steering shaft, not shown, is affixed to the upper section 38 of the lower unit 34 by means of a bracket 42. The steering shaft is supported for steering movement about a vertically extending axis within a swivel bracket 44. The swivel bracket 44 is connected by means of a pivot pin 46 to a clamping bracket 48 which is attached to a transom portion of a hull 50 of the watercraft. The pivot pin 46 permits the outboard motor 20 to be trimmed and tilted up about the horizontally disposed axis formed by the pivot pin 46.

Figure 2:
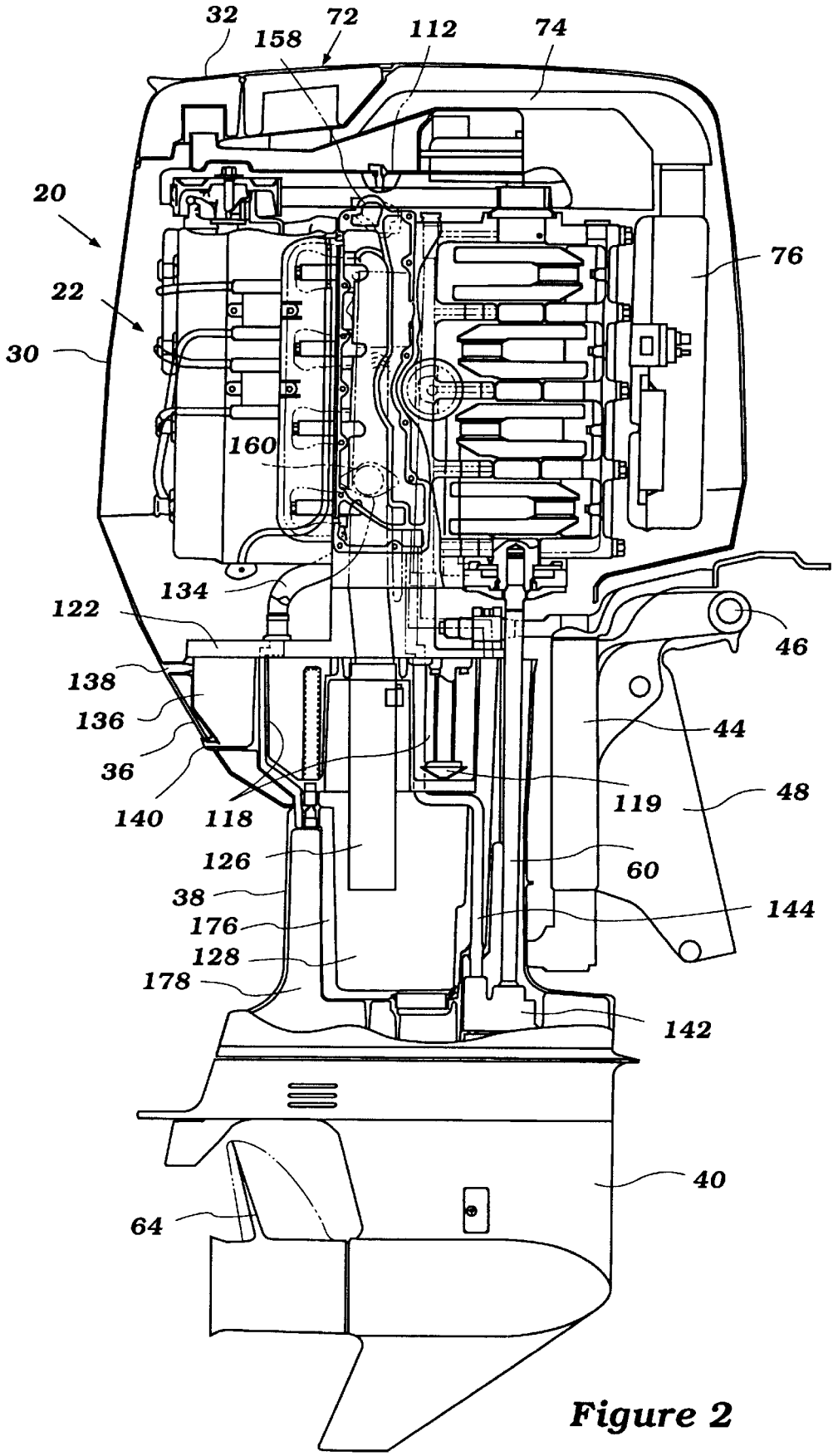
FIG. 2 is a side view, in partial cross-section, illustrating an internal combustion engine of the inline variety having an exhaust cooling arrangement in accordance with the present invention for use in powering the motor illustrated in FIG. 1.
Figure 3:
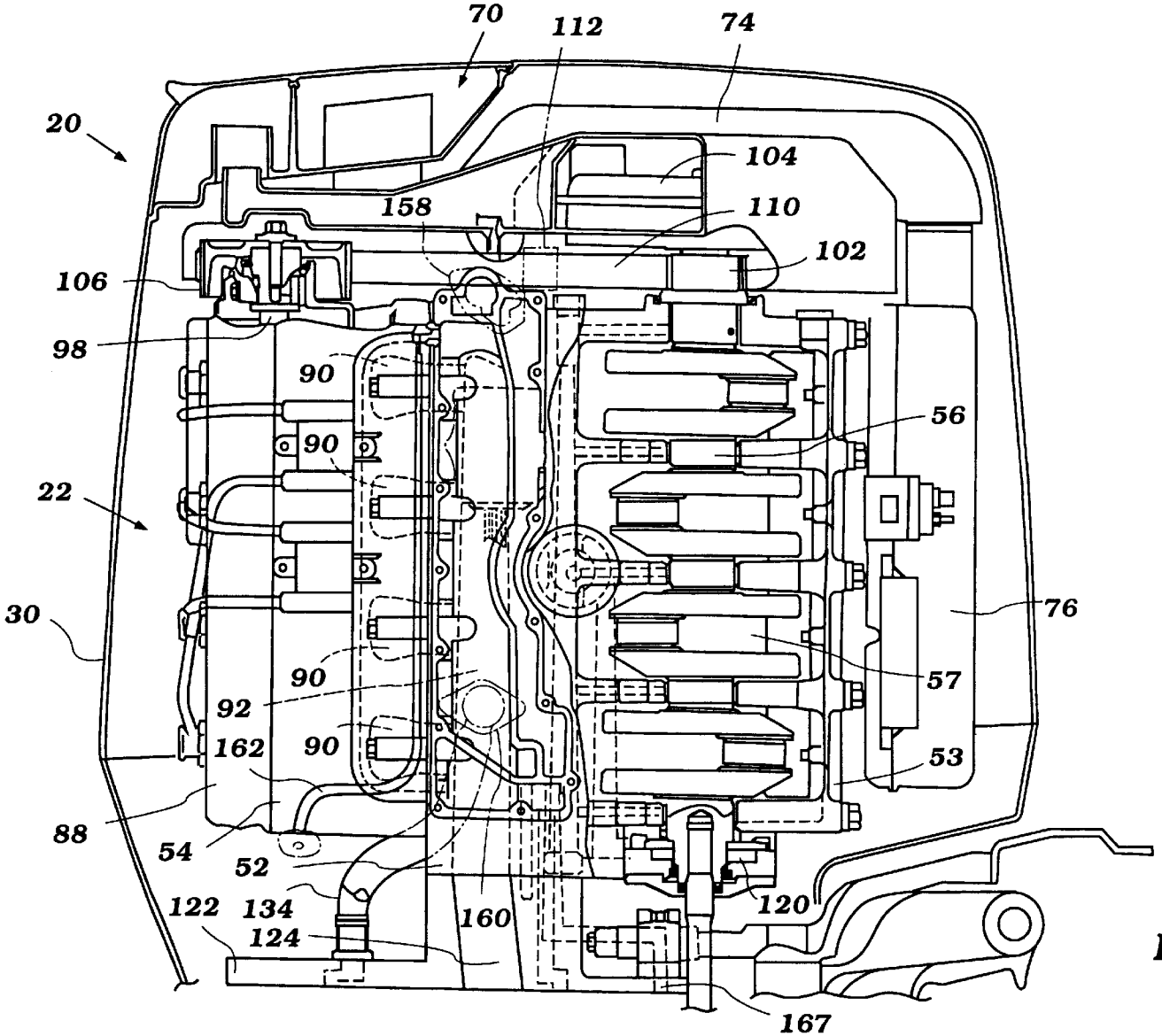
FIG. 3 is an enlarged view of the engine illustrated in FIG. 2.

As best illustrated in FIG. 2 and 3, the power head 26 of the outboard motor 20 includes the engine 22 which is positioned within the cowling portion 30. In the embodiment of the present illustrated in FIGS. 2–8, the engine 22 is preferably of the inline, four-cylinder, four-cycle variety, and thus includes a cylinder block 52 which has a cylinder bank closed by a cylinder head assembly 54 in a manner which will be described. As also illustrated in FIGS. 2 and 3, the engine 22 is preferably oriented within the cowling 30 such that its cylinder head 54 is positioned on the block 52 on the side opposite the watercraft's transom.

A crankshaft 56 is rotatably journalled in a crankcase chamber 57 formed by the cylinder block 52 a crankcase cover 53. As is typical with outboard motor practice, the engine 22 is mounted in the power head 26 so that the crankshaft 56 rotates about a vertically extending axis. This facilitates coupling to a drive shaft 60 in a manner which will be described.

The drive shaft 60 depends into the lower unit 34, wherein it drives a conventional bevel gear and a forward-neutral-reverse transmission. The transmission is not illustrated herein, because its construction per se forms no part of the invention. Therefore, any known type of transmission may be employed.

The transmission drives a propeller shaft which is journalled within the lower section 40 of the lower unit 34 in a known manner. A hub 62 of a propeller 64 is coupled to the propeller shaft for providing a propulsive force to the watercraft 24 in a manner well known in this art.

Figure 7:
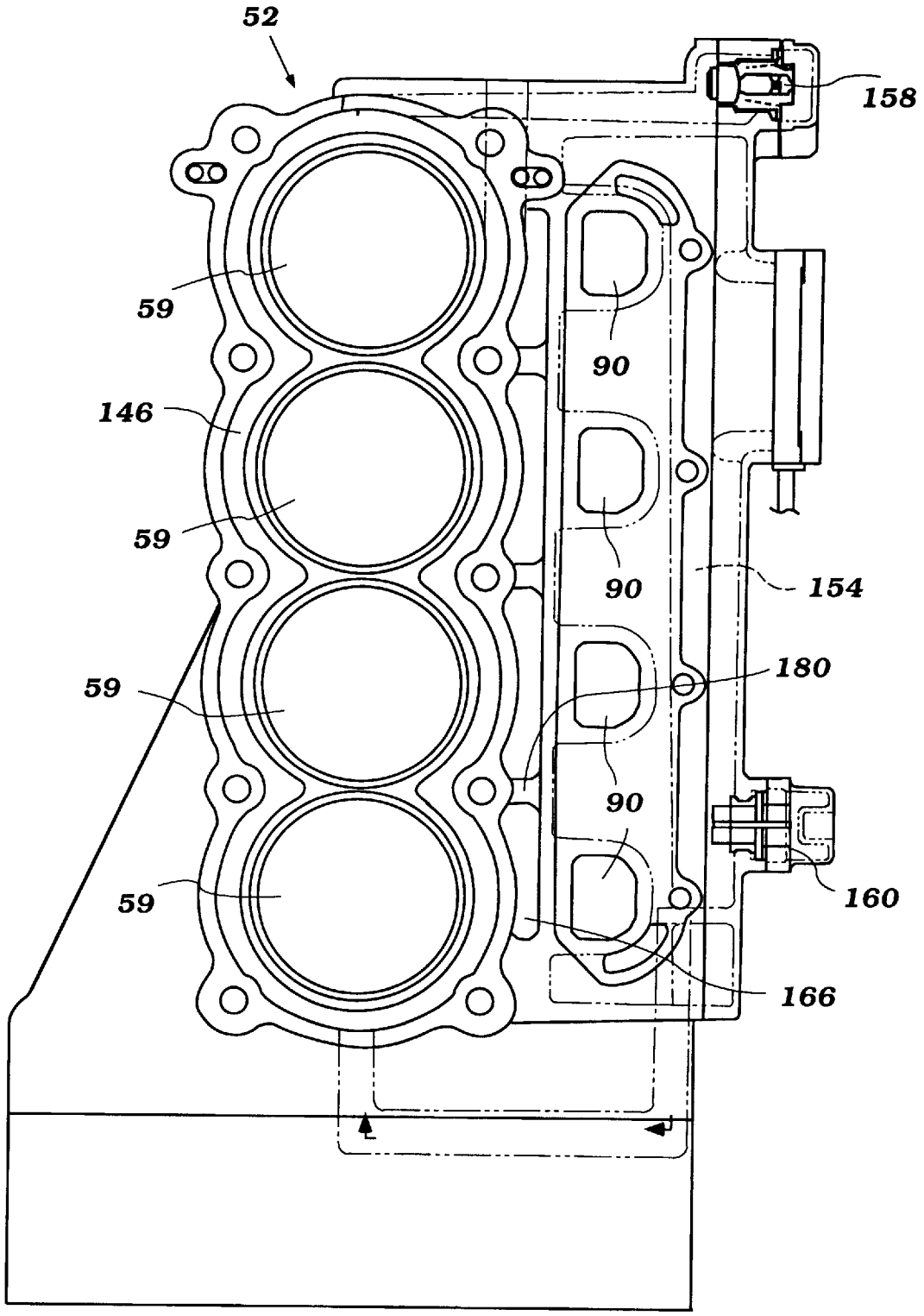
FIG. 7 is a top view of a cylinder block of the engine illustrated in FIG. 6, taken along the line indicated as 7—7 therein.

The construction of the engine 22 and the exhaust manifold cooling arrangement of the present invention will now be described in more detail. As illustrated in FIGS. 2, 3 and 7, the engine 22 has a number of variable volume combustion chambers 59, preferably totaling four in number, arranged in vertical, inline fashion. It should be understood that there may be as few a one combustion chamber, or more than four.

Each combustion chamber has a piston 66 mounted therein for reciprocation, the piston connected to the crankshaft 56 via a connecting rod 68. The crankshaft 56 rotates within the crankcase chamber 57 defined by the cylinder block 52 and the cover 53 connected thereto. The cover 53 is preferably connected to the cylinder block 52 via a number of bolts, as is known in the art.

As illustrated in FIGS. 2, 3, 5 and 6, an intake system 70 provides air to each combustion chamber. The intake system 70 includes an air intake 72 positioned adjacent the vent 32 in the cowling 30. As best illustrated in FIG. 2, air drawn through this intake 72 passes into an air passage formed between the cowling 30 and a camshaft drive cover 74 positioned on the top of the engine 22, to a surge tank 76. Air is routed from the surge tank 76 by a runner 78 to an inlet passage 80 positioned within the cylinder head 54 leading to the combustion chamber. An inlet passage 80 is provided corresponding to each combustion chamber 59.

Means are provided for controlling the passage of air through each inlet passage 80 to the combustion chambers 59. Preferably, this means comprises an intake valve 82. As illustrated, all of the intake valves 82 are preferably actuated by an intake camshaft 84. The intake camshaft 84 is mounted for rotation with respect to the head 54 and connected thereto with a bracket 86. The camshaft 84 is enclosed by a camshaft cover 88 which is connected to the head 54.

An exhaust system is provided for routing the products of combustion within the combustion chambers 59 to a point external to the engine 22. In particular, an exhaust passage 90 leads from each combustion chamber to a common exhaust passage 92 in an exhaust manifold portion 94 of the engine 22. The remainder of the exhaust system will be described in more detail below.

Means are also provided for controlling the flow of exhaust from each combustion chamber 59 to its respective exhaust passage 92. Preferably, this means comprises an exhaust valve 96. Like the intake valves 82, the exhaust valves 96 are preferably all actuated by an exhaust camshaft 98. The exhaust camshaft 98 is journalled for rotation with respect to the cylinder head 54 and connected thereto with a bracket 100. The exhaust camshaft 98 is enclosed within the camshaft cover 88.

Figure 5:
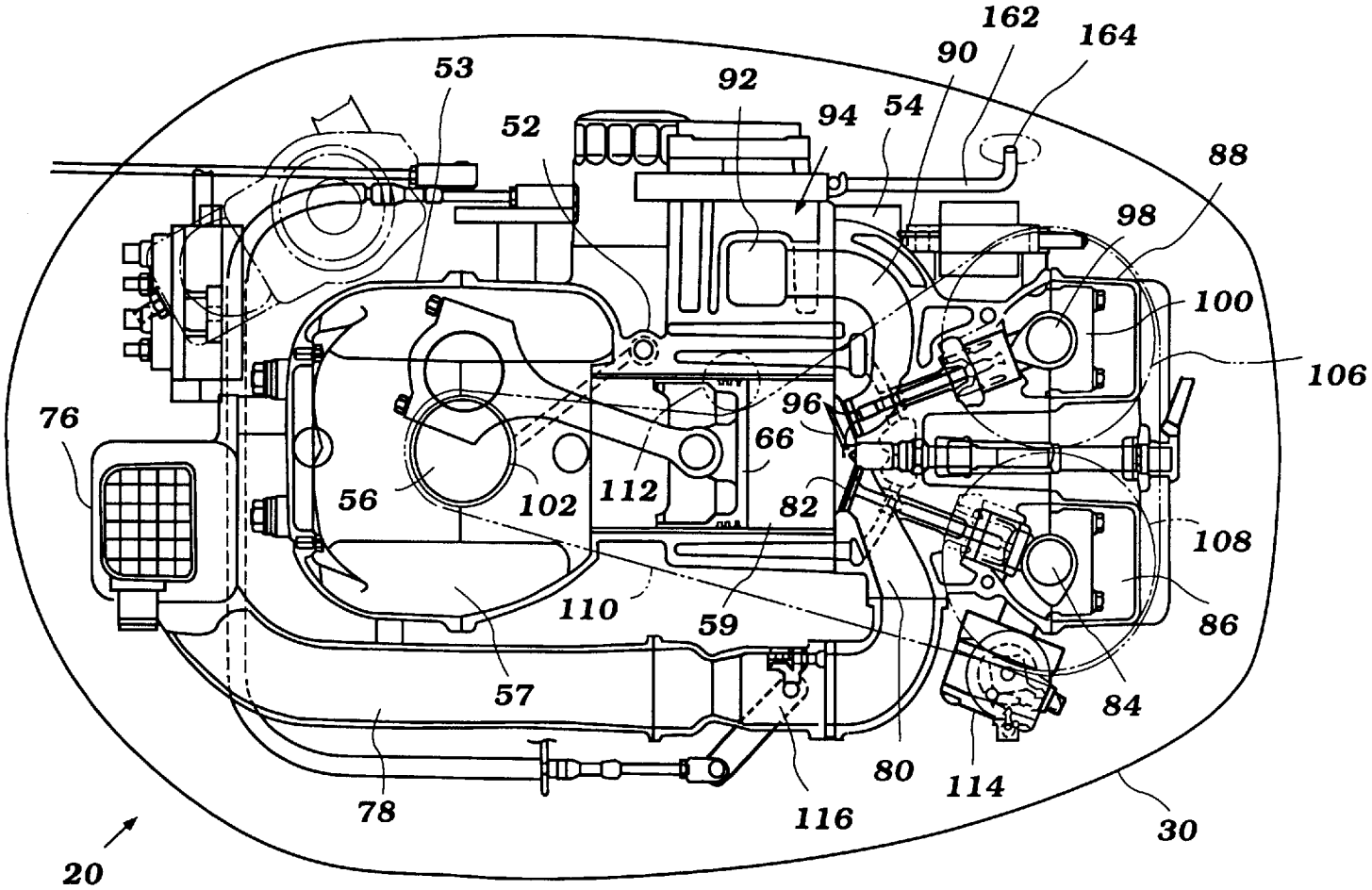
FIG. 5 is a top view of the engine illustrated in FIG. 2.

As best illustrated in FIGS. 3 and 5, means are provided for driving the camshafts 84,98. A timing belt pulley 102 is mounted on a top end of the crankshaft 56 positioned outside of the cylinder block 52, and just below a flywheel 104 also positioned on the crankshaft 56. An exhaust camshaft pulley 106 is mounted on an end of the exhaust camshaft 98 extending from the top end of the engine 22, and an intake camshaft pulley 108 is mounted on an end of the intake camshaft 84 extending from the top end of the engine. A drive belt 110 extends around the timing belt pulley 102 and the exhaust and intake camshaft pulleys 106,108, whereby the crankshaft 56 indirectly drives the camshafts 84,98. One or more tensioner pulleys 112 may be provided for maintaining the belt in a taunt condition.

A fuel delivery system is provided for delivering fuel to each combustion chamber 59 for combustion therein. The fuel delivery system preferably includes a fuel tank (not shown) and a fuel pump 114 (see FIG. 5) for pumping fuel from the tank and delivering it to each combustion chamber 59. As known to those skilled in the art, the fuel may be delivered into the incoming air stream, such as with a carburetor or fuel injector, or directly injected into the combustion chamber with a fuel injector.

A throttle 116 is provided for controlling the flow of air into each combustion chamber 59. Preferably, the throttle 116 comprises a moveable plate positioned within the runner 78. The throttle 116 is preferably controlled through a cable by the operator of the watercraft 24.

A suitable ignition system is provided for igniting an air and fuel mixture within each combustion chamber 59. Such systems are well known to those skilled in the art, and as such forms no portion of the invention herein, such is not described in detail here.

The engine 22 includes a lubricating system for providing lubricant to the various portions of the engine. The lubricating system is not described in detail here, and may be of any type found suitable to those skilled in the art. Generally, the lubricating system includes an oil reservoir 118 positioned below the engine 22 (see FIG. 2). The reservoir 118 is in communication with an oil pump 120 via a suction tube 119. The oil pump 120 is preferably positioned on the end of the crankshaft 56 at the bottom of the engine 22. The oil pump 120 pumps lubricant from the reservoir 118 through oil passages throughout the engine 22. The pumped oil drains from the engine 22 back to the reservoir 118 for recirculation by the pump 120.

Figure 6:
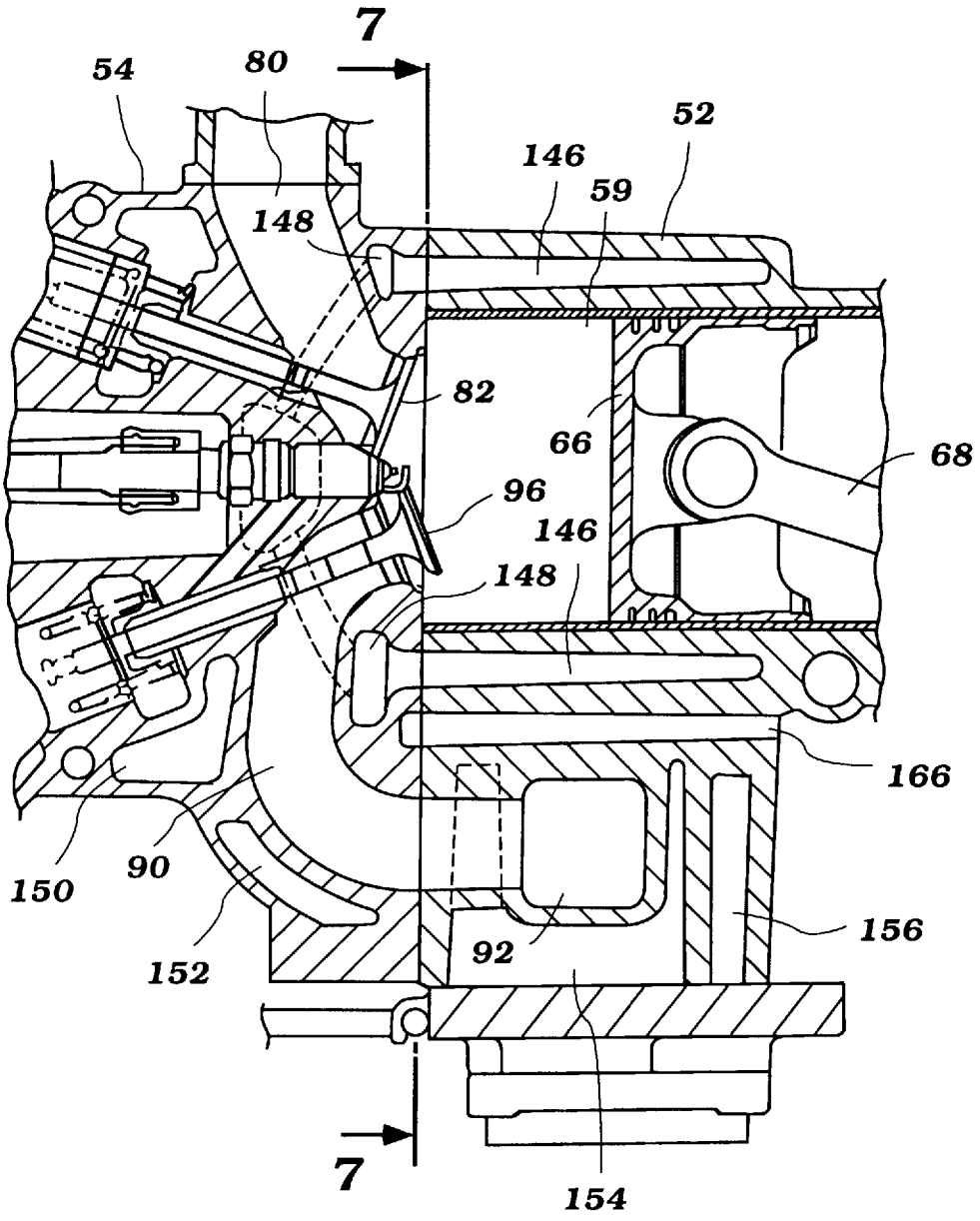
FIG. 6 is a partial cross-sectional view of a cylinder block, head and exhaust manifold of the engine illustrated in FIG. 2, having a cooling arrangement in accordance with the present invention.

As illustrated in more detail in FIG. 6, the exhaust manifold is preferably formed integrally with the cylinder block 52. In this arrangement, the common exhaust passage 92 is simply a passage extending generally vertically through an extended portion of the cylinder block 52.

Figure 4:
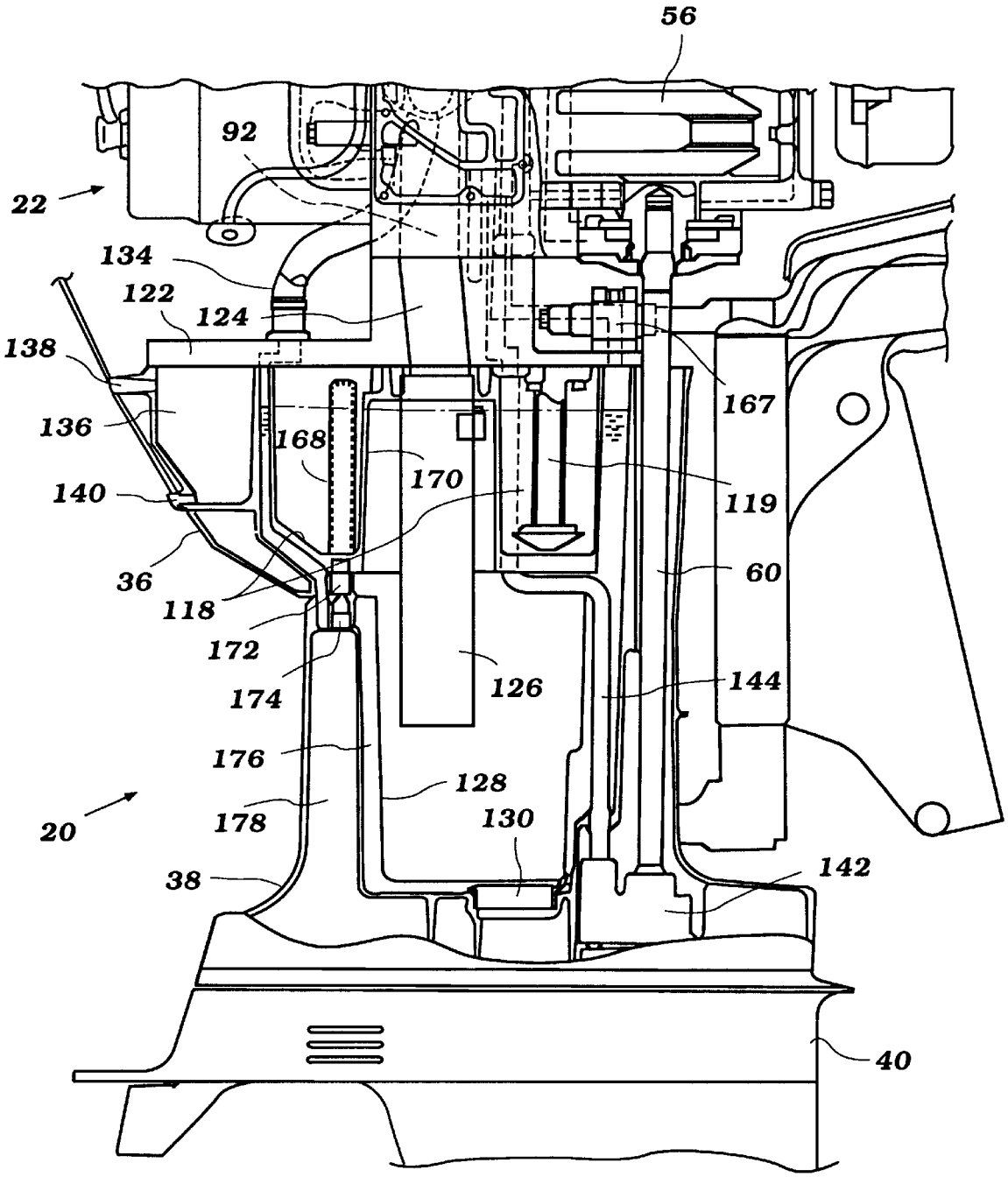
FIG. 4 is an enlarged view of a lower portion of the engine illustrated in FIG. 2 and motor components related thereto.

As best illustrated in FIG. 4, an exhaust guide 122 is positioned at the bottom end of the engine 22. The exhaust guide 122 has a passage 124 extending therethrough which is aligned with the passage 92 at its top side. An exhaust pipe 126 is connected to the bottom side of the exhaust guide 122 in alignment with the passage 124. The exhaust pipe 126 terminates within a chamber of a muffler 128.

The muffler 128 is positioned within the lower unit 38 and between the drive shaft 60 and a cooling water drain system. An exhaust gas outlet 130 is provided in the bottom end of the muffler 128, through which the exhaust gas is routed to a point external of the motor 20, normally through a passage extending through the hub 62 of the propeller 64.

When the exhaust pressure is low, which is often the case when the engine speed is low, the exhaust gas is diverted to an above-water exhaust gas discharge. In the embodiment illustrated in FIGS. 2 and 4, this discharge comprises an expansion chamber 136 and first and second exhaust ports 138,140. The exhaust ports 138,140 extend through the apron 36 from the chamber 136 for exhausting gases therefrom. The lower exhaust port 140 allow condensed liquids to drain from the chamber 136.

As illustrated in FIG. 6, a space 166 is provided between the common exhaust passage 92 and each combustion chamber 59 for reducing rate of heat transfer from exhaust gases flowing through the passage 92 to the combustion chambers 59. In the arrangement illustrated in FIG. 6, the space 166 is an elongate passage extending from the exterior of the cylinder block 52 inwardly therethrough to a mating portion in the cylinder head 54, are positioned within the block. As illustrated in FIG. 7, a space 166 is preferably provided between the passage 92 and a cooling water jacket 146 surrounding each combustion chamber 59. As also illustrated in FIG. 7, web sections 180 are preferably provided between the spaces 166 for maintaining strength and rigidity of the cylinder block 52.

In accordance with the present invention, and as illustrated in FIGS. 2–8, the engine 22 includes an improved liquid cooling system. First, cooling water is pumped by a water pump 142 positioned in the lower unit 34 from the body of water in which the motor 22 is positioned. The pump 142 is preferably driven by the drive shaft 60, and expels the cooling water upwardly through a cooling water pipe 144. This coolant passes into a number of coolant water passages throughout the cylinder block 52 and head 54. These passages include a cooling passage 146 in the form of a water jacket surrounding the portion of the combustion chambers 59 defined by the cylinder block 52, and corresponding passages 148 surrounding the portion of the combustion chambers defined by the cylinder head 54. Cooling water passages 150,152 are further provided in the cylinder head 54 adjacent the exhaust valves 96 and exhaust passages 90. A cooling water passage 154 is preferably provided in the manifold portion 94 of the cylinder block 52 on a side of the exhaust passage 92 defined therein opposite the combustion chambers 59. All of the cooling water passages lead to a cooling water outlet passage 156.

As known to those skilled in the art, the cooling system preferably includes at least one thermostat 158 for controlling the flow of cooling water through the various coolant water passages. Preferably, and as described in more detail below, the thermostat 158 is arranged to prevent the flow of cooling water through the engine, and especially the cooling passages 146,148 surrounding the combustion chambers 59, when the temperature of the coolant therein is below a pre-determined temperature, thereby allowing the engine to warm up.

In addition, a coolant pressure relief valve 160 is provided. This valve 160 is preferably positioned along the cooling liquid flow path just before the coolant enters the passages 146,148 surrounding the combustion chambers 59. Thus, in the arrangement illustrated in FIGS. 2–8, the valve 160 positioned along the cooling water passage 154. The valve 160 is connected to a relief line 134 extending to a cooling water chamber 176, described in more detail below. In the instance where the cooling water pressure within the cooling passages exceeds a predetermined pressure, the pressure relief valve 160 opens, allowing cooling water to flow through the line 134 to the chamber 176.

Referring to FIG. 5 a cooling water tell-tale is provided so that the operator of the watercraft 24 may readily verify that cooling water is being provided to the engine 22. In particular, a pilot line 162 extends to a port 164 from one of the coolant passages. Coolant under pressure is delivered through the line 162 and out the port 164, which is above the water line, evidencing to the operator that cooling water is being supplied to the engine.

Cooling water which circulates through the engine 22 to the outlet passage 156 passes through a cooling water discharge passage 167 in the exhaust guide 122 into the cooling water pool or chamber 176 which extends around the oil tank 118, muffler 128 and other components. An overflow pipe 168 has its top end positioned within the chamber 176, and extends to first and second passages 172,174 leading to a discharge tank 178. Cooling water which is directed to the tank 178 is discharged from the motor 20 back to the body of water from which it was drawn.

Figure 8:
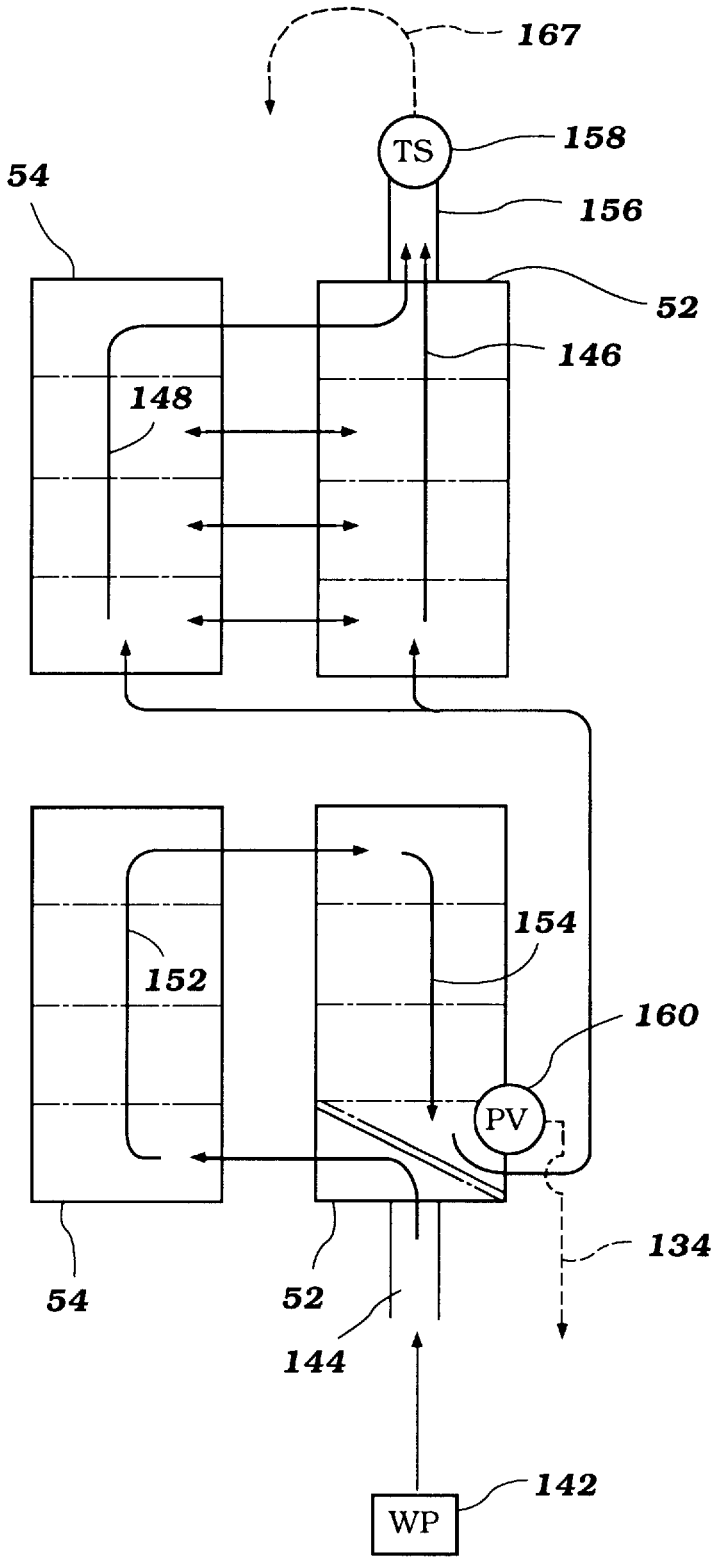
FIG. 8 is schematic illustrating a first cooling path for the engine illustrated in FIG. 2.
Figure 9:
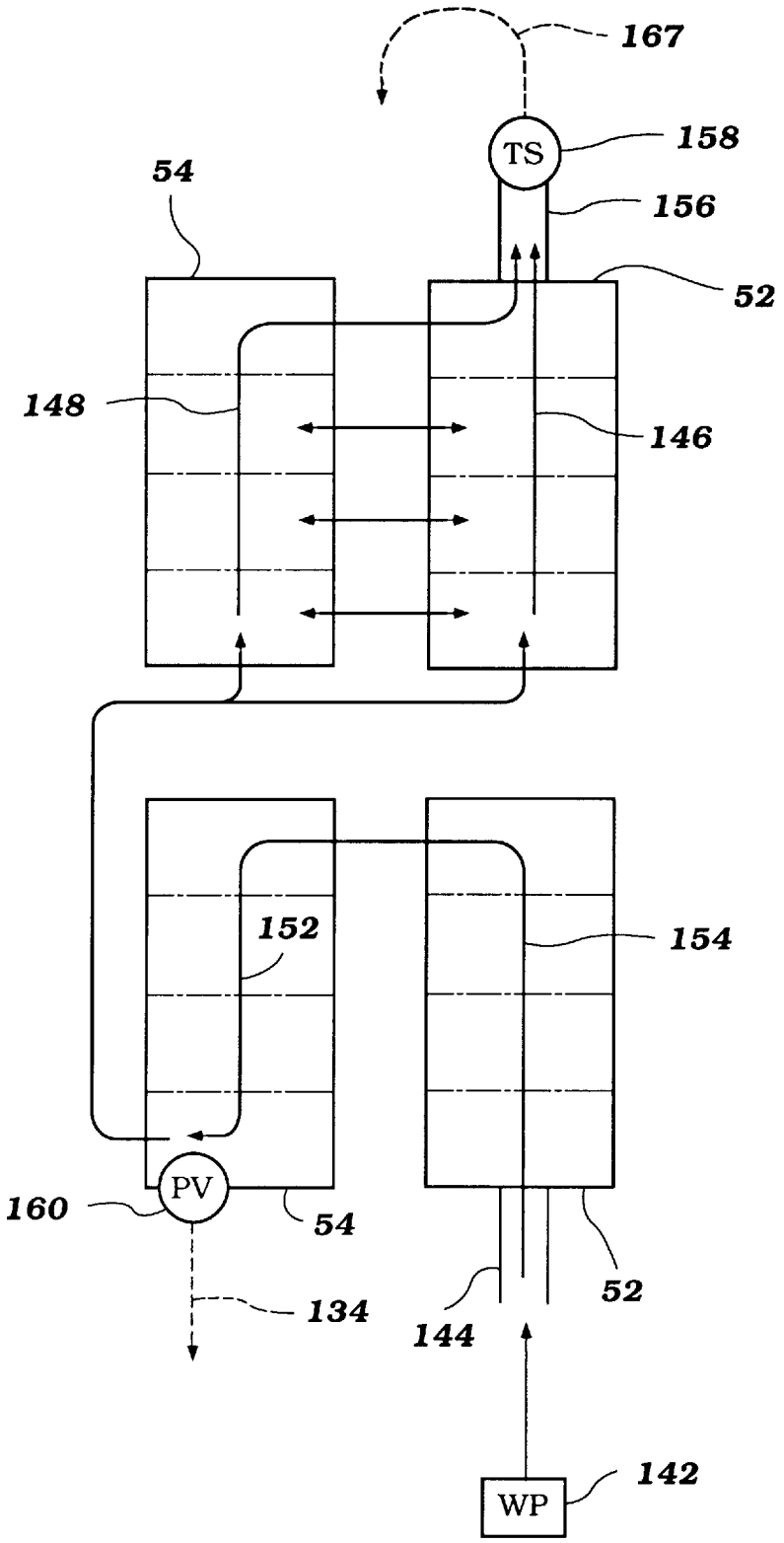
FIG. 9 is a schematic illustrating a second cooling path for the engine illustrated in FIG. 2.
Figure 10:
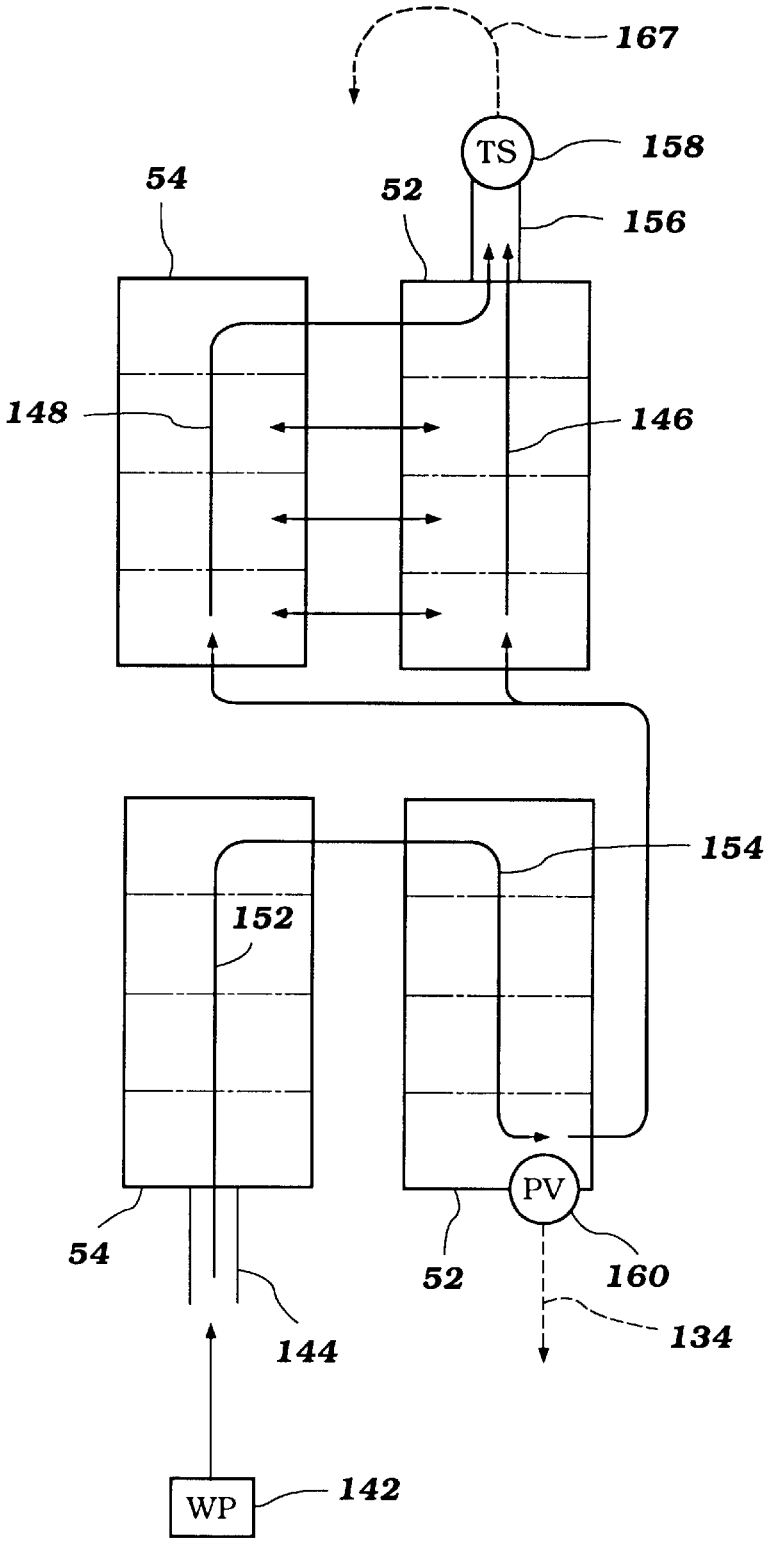
FIG. 10 is a schematic illustrating a third cooling path for the engine illustrated in FIG. 2.
Figure 11:
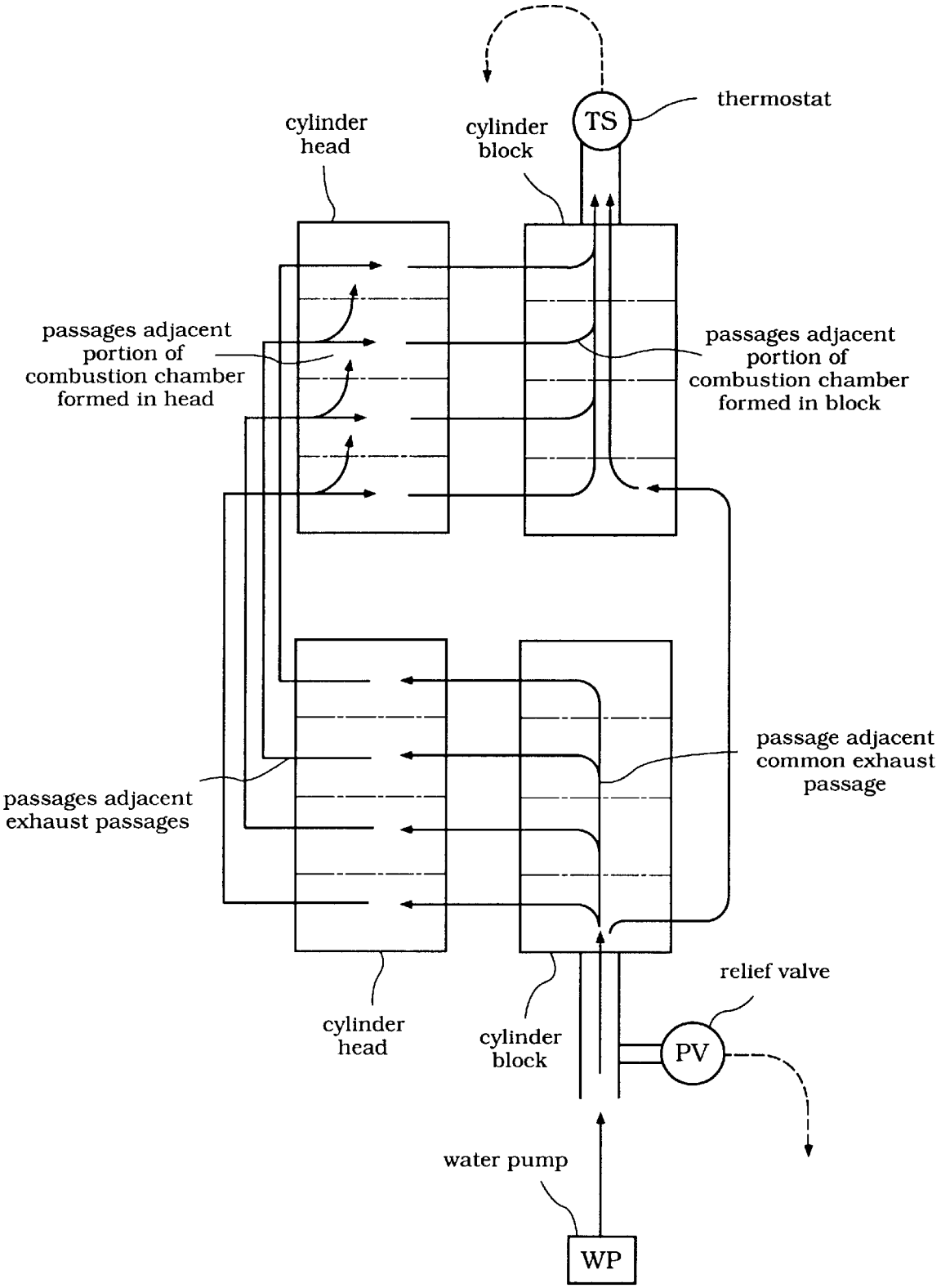
Figure 11 Prior Art
FIG. 11 is a schematic illustrating a liquid cooling path for an engine in accordance with the prior art.

FIGS. 8–10 schematically illustrate three different cooling liquid flow paths, with associated components, for the engine 22 in accordance with the present invention.

In a first embodiment illustrated in FIG. 8, which corresponds to the arrangement of the engine 22 illustrated in FIGS. 2–7, the cooling water is pumped by the pump 142 through the pipe 144 first through a short passage in the cylinder block 52 to the passage 152 for cooling the exhaust passages 90 through the cylinder head 54. Next, the cooling water passes into the passage 154 for cooling the common exhaust passage 92 in the cylinder block 52. In this embodiment, the pressure relief valve 160 is positioned along the passage 154, before the cooling water is routed through passages 146 and 148, about the combustion chambers 59 in the cylinder block 52 and head 54, respectively. As illustrated, the thermostat 158 is positioned along the cooling passage 156 leading to the cooling water discharge passage 167.

The liquid cooling arrangement illustrated in FIG. 8 has the advantage that the cooling water which reaches the passages 146,148 in the cylinder block and head is of a relatively uniform temperature. In addition, cold coolant is not introduced into these passages because the coolant is first warmed by the exhaust as it passes through the passages 152,154.

A second embodiment liquid cooling arrangement is illustrated in FIG. 9. In this arrangement, the cooling water is pumped through the pipe 144 to the passage 154 extending along the exhaust passage 92. Then, the cooling water is routed to the passage 152 extending through the cylinder head 54 adjacent the exhaust passages 90. The cooling water is then routed to the passages 146 and 148 in the cylinder block and head 52,54, respectively, for cooling the combustion chambers 59. In this arrangement, the pressure relief valve 160 is positioned between where the cooling water exits the passage 152 in the cylinder head 54, and the passages 146,148 about the combustion chambers.

The liquid cooling arrangement illustrated in FIG. 9 has generally the same advantages of the system illustrated in FIG. 8.

A third embodiment liquid cooling arrangement is illustrated in FIG. 10. In this arrangement, the cooling water is supplied through the pipe 144 to the passage 152 in the cylinder head 54 for cooling the exhaust passage 90. Next, the cooling water is routed through the cooling water passage 154 in the cylinder block 52 for cooling the exhaust passage 92. The cooling water is then routed to the passages 146,148 in the cylinder block and head, respectively, for cooling the combustion chambers 59. In this arrangement, the pressure relief valve 160 is positioned between where the cooling water passes from the cylinder block 52 through passage 154 and where it passes into passages 146,148. As with the embodiment illustrated in FIG. 8, the thermostat 158 is positioned downstream of the passages 146,148.

The liquid cooling arrangement illustrated in FIG. 10 has the advantages described in conjunction with FIG. 8, above.

Yet another arrangement of the present invention with an engine is illustrated in FIGS. 12–16. These figures illustrate the cooling arrangement of the present invention as adapted to a "V"-type engine for powering an outboard motor 20 similar to that illustrated in FIG. 1.

As illustrated in FIGS. 9–16 there is provided a "V"-type, four-cycle engine 222 having six combustion chambers 259. The engine 222 may have a greater or lesser number of combustion chambers, such as two, four, or eight or more.

Figure 13:
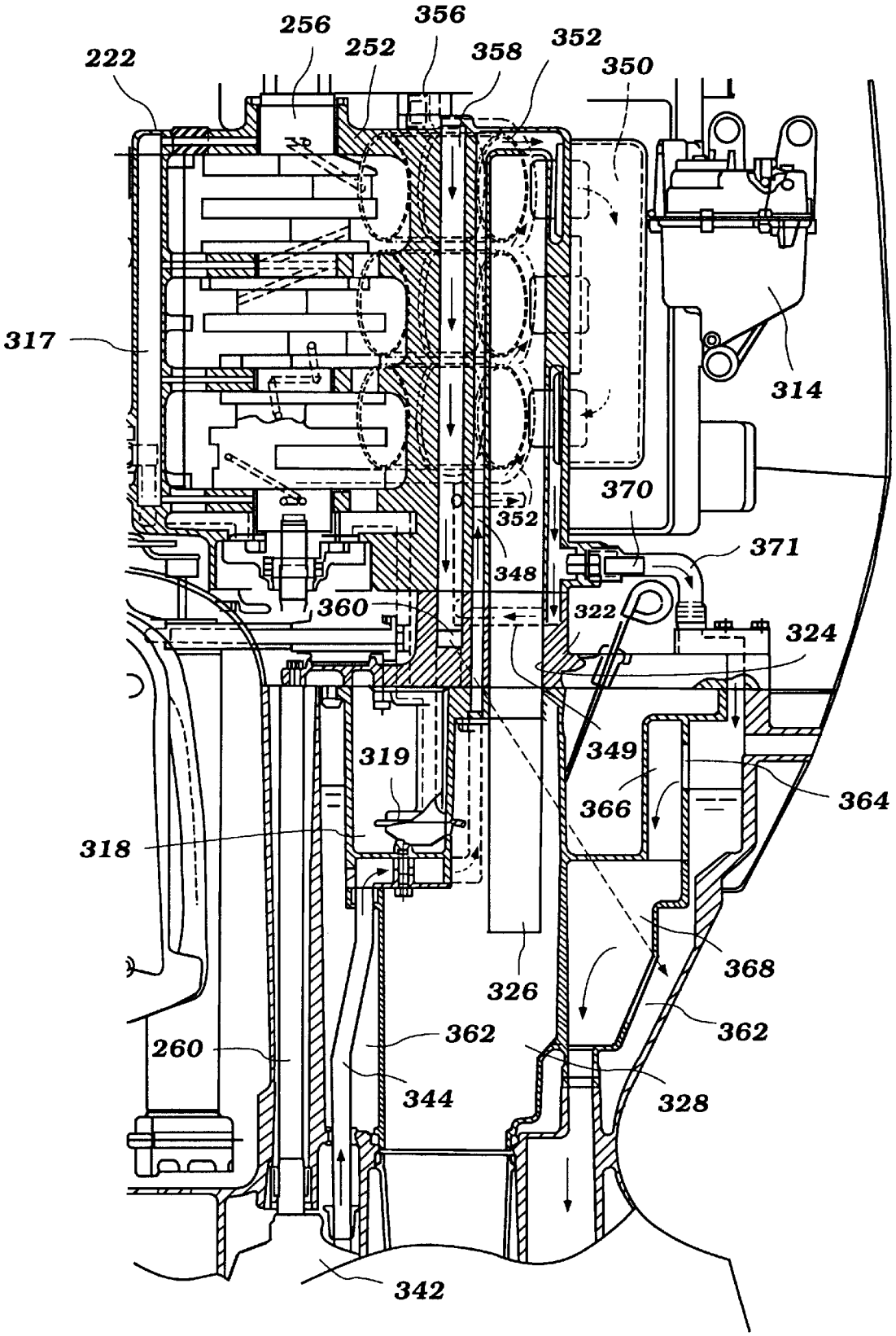
FIG. 13 is an enlarged, partial cross-sectional side view of the engine illustrated in FIG. 12.

As best illustrated in FIG. 13, the engine 222 has a cylinder block 252 with a first cylinder head **254*a* and a second cylinder head 254*b* connected thereto, defining first and second cylinder banks. Each bank of cylinders preferably defines three combustion chambers 259**.

A piston 266 is movably positioned in each combustion chamber 259. Each piston 266 is connected to a connecting rod 268 extending to a vertically extending crankshaft 256. The crankshaft 256 is arranged in driving relation with a drive shaft 260, in a manner similar to the camshaft 56 of the engine 22 described above.

The crankshaft 256 is journalled for rotation with respect to the cylinder block 252. A crankcase cover 253 engages an end of the block 252, defining therewith a crankcase chamber 257 within which the crankshaft rotates.

As with the engine 22 described above, the engine 222 includes an air intake system 270 for providing air to each combustion chamber 259. As illustrated in FIG. 9, air passes through the vent 32 in the motor cowling 30 into an opening 271 of an air plenum 272, and thereafter to a main intake pipe 273. As illustrated, this air plenum 272 is positioned above a flywheel cover 274. The main intake pipe 273, in turn, branches to first and second surge tanks **276*a,b* having branches 277 extending therefrom. Preferably, each surge tank 276*a,b* has a three branches 277 extending therefrom, one for each combustion chamber 259** of a bank corresponding thereto.

Each branch 277 extends to a passage 278 through an intake manifold 279. This passage 278 extends through an intake passage 280 in the cylinder head **254*a,b* to its respective combustion chamber 259**.

Means are provided for controlling the flow of air into each combustion chamber 259. Preferably, this means comprises an intake valve 282 corresponding to each intake passage 280. As illustrated, all of the intake valves 282 for each bank of cylinders are preferably actuated by a single intake camshaft 284. The intake camshaft 284 is mounted for rotation with respect to the head 254 and connected thereto with a bracket. The camshafts 284 are enclosed by a camshaft cover 288 which is connected to the respective head 254*a,b*.

An exhaust system is provided for routing the products of combustion within the combustion chambers 259 to a point external to the engine 222. In particular, an exhaust passage 290 leads from each combustion chamber to a common exhaust passage 292 in an exhaust manifold portion 294 of the engine 222. The remainder of the exhaust system will be described in more detail below.

Means are also provided for controlling the flow of exhaust from each combustion chamber 259 to its respective exhaust passage 290. Preferably, this means comprises an exhaust valve 296. Like the intake valves 282, the exhaust valves 296 of each cylinder bank are preferably all actuated by a single exhaust camshaft 298. Each exhaust camshaft 298 is journalled for rotation with respect to its respective cylinder head 254*a,b* and connected thereto with a bracket. The exhaust camshaft 298 is enclosed within the camshaft cover 288.

Figure 12:
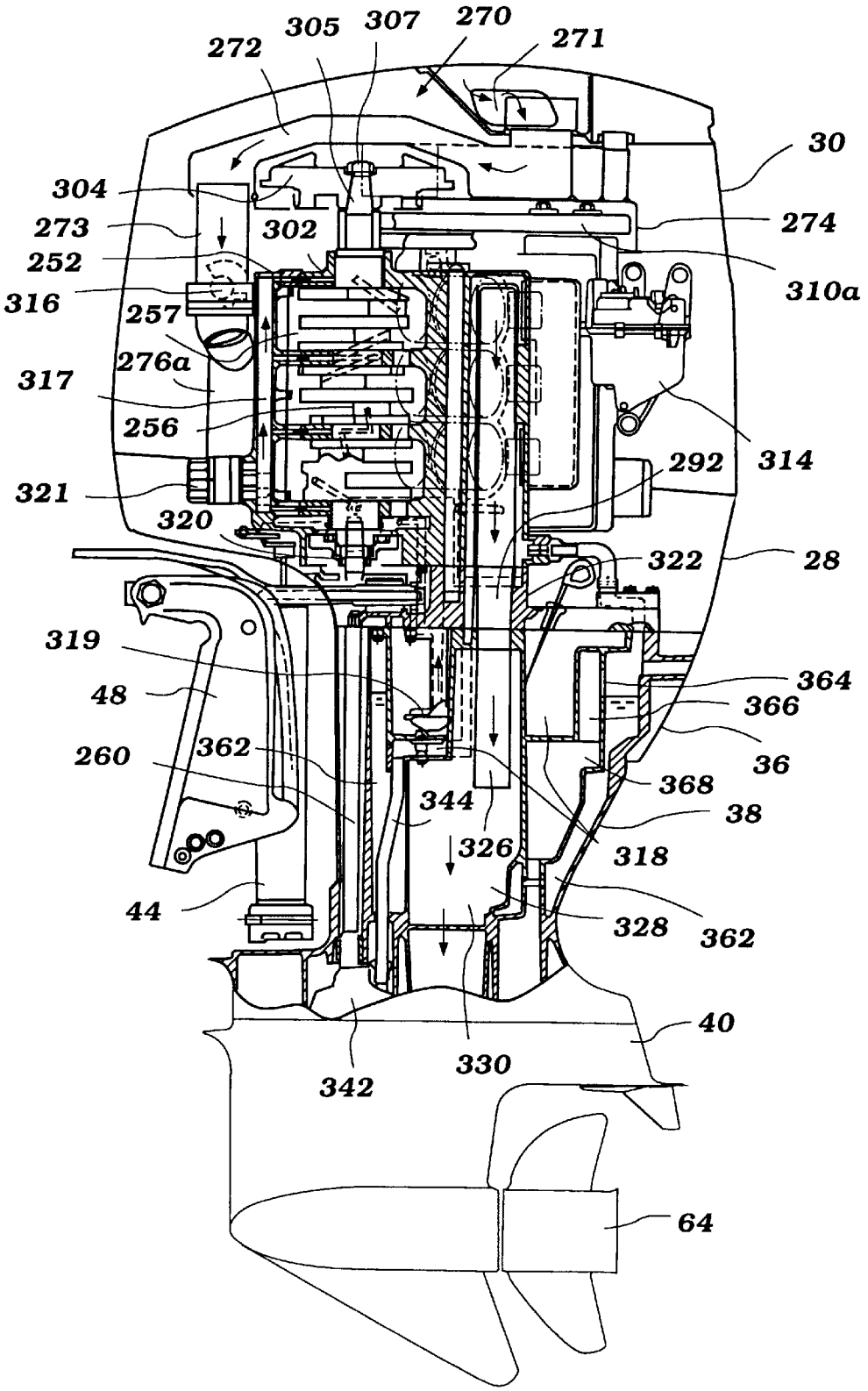
FIG. 12 is a side view, in partial cross-section illustrating an internal combustion engine of the "V"-type having an exhaust manifold cooling arrangement in accordance with the present invention for use in powering an outboard motor similar to that illustrated in FIG. 1.
Figure 17:
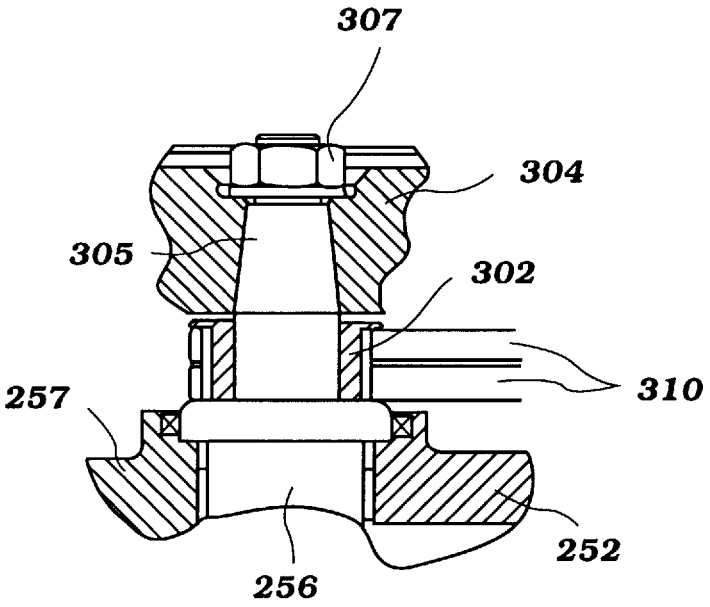
FIG. 17 illustrates an end of a crankshaft of the engine illustrated in FIG. 12, the crankshaft having a flywheel and drive pulley mounted thereto, the drive pulley for driving a camshaft drive belt.
Figure 18:
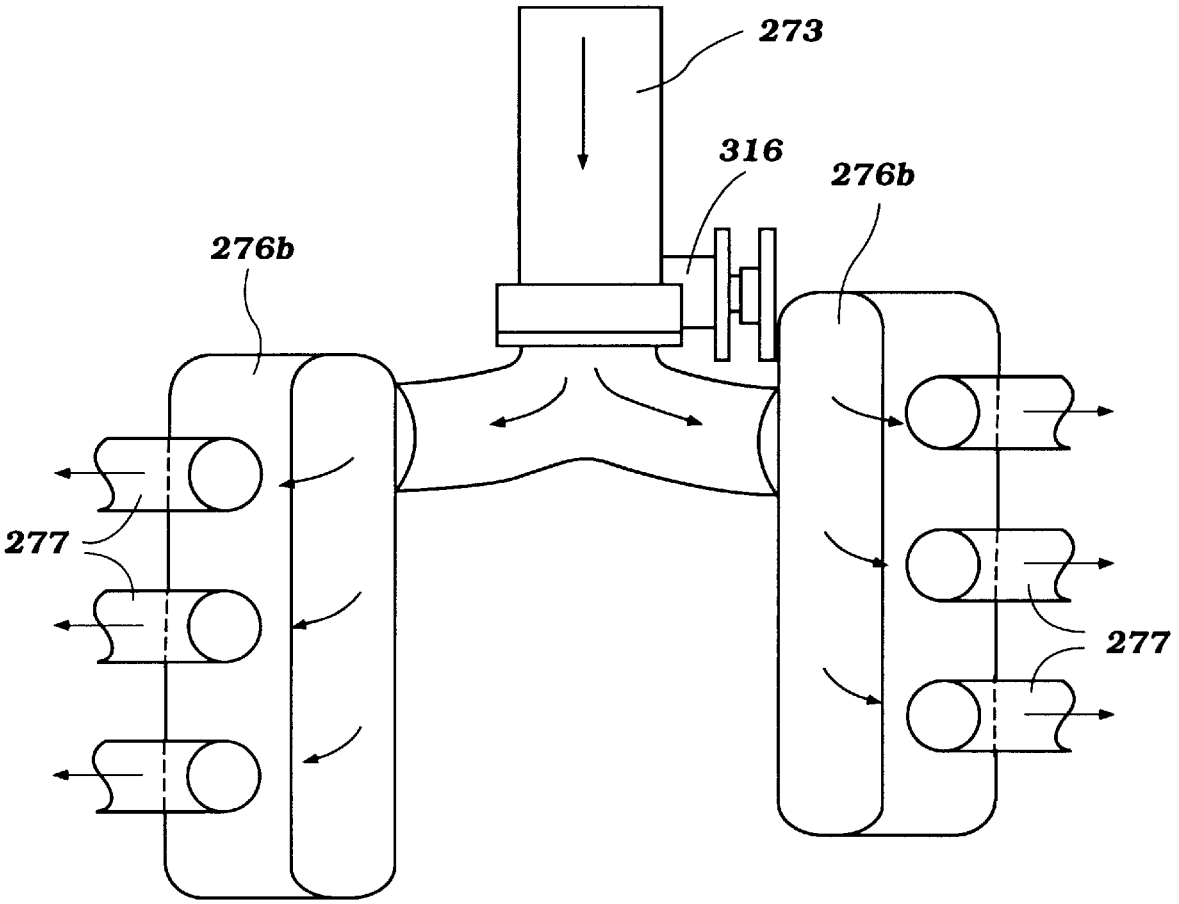
FIG. 18 is a schematic view illustrating the air intake system of the engine illustrated in FIG. 12.

As best illustrated in FIGS. 12 and 17, means are provided for driving the camshafts 284,298. A timing belt pulley 302 is mounted on a top end of the crankshaft 256 positioned outside of the cylinder block 252, and just below a flywheel 304 also positioned on the crankshaft 256. An exhaust camshaft pulley 306 is mounted on an end of each exhaust camshaft 298 extending from the top end of the engine 222, and an intake camshaft pulley 308 is mounted on an end of each intake camshaft 284 extending from the top end of the engine. A first drive belt 310*a* extends around the timing belt pulley 302 and the exhaust and intake camshaft pulleys 206,208, corresponding to a first cylinder bank, and a second drive belt 310*b* extends around the timing belt pulley 302 and the exhaust and intake camshaft pulleys 206,208 of the other cylinder bank. By this arrangement, the camshaft 256 indirectly drives the camshafts 284,298. One or more tensioner pulleys (not shown) may be provided for maintaining the belt in a taunt condition. As illustrated in FIGS. 12 and 17, the flywheel 304 is preferably positioned on a tapered fitting 305 attached to the crankshaft 256 and held in place with a nut 307.

A fuel delivery system is provided for delivering fuel to each combustion chamber 259 for combustion therein. The fuel delivery system preferably includes a fuel tank (not shown) and a fuel pump (not shown) for pumping fuel from the tank and delivering it to each combustion chamber 259. A vapor separator 314 may be included in the fuel system, and preferably, the fuel is injected into the air stream flowing through each air intake branch 277 with a fuel injector 315.

A throttle 316 is provided for controlling the flow of air into the combustion chambers 259. Preferably, the throttle 316 comprises a moveable plate positioned within air intake pipe 273. The throttle 316 is preferably controlled through a cable by the operator of the watercraft 24.

A suitable ignition system is provided for igniting an air and fuel mixture within each combustion chamber 259. Such systems are well known to those skilled in the art, and as such forms no portion of the invention herein, such is not described in detail here.

Referring to FIGS. 12 and 13, the engine 222 includes a lubricating system for providing lubricant to the various portions of the engine. The lubricating system is not described in detail here, and may be of any type found suitable to those skilled in the art. Generally, the lubricating system includes an oil reservoir 318 positioned below the engine 222. The reservoir 318 is in communication with an oil pump 320 via a suction tube 319. The oil pump may be positioned on the end of the crankshaft 256 at the bottom of the engine 222. The oil pump pumps lubricant from the reservoir 318 through an oil filter 321, and on to oil passages, such as a main gallery 317 throughout the engine 222. The pumped oil drains from the engine 222 back to the reservoir 318 for recirculation by the pump.

Figure 15:
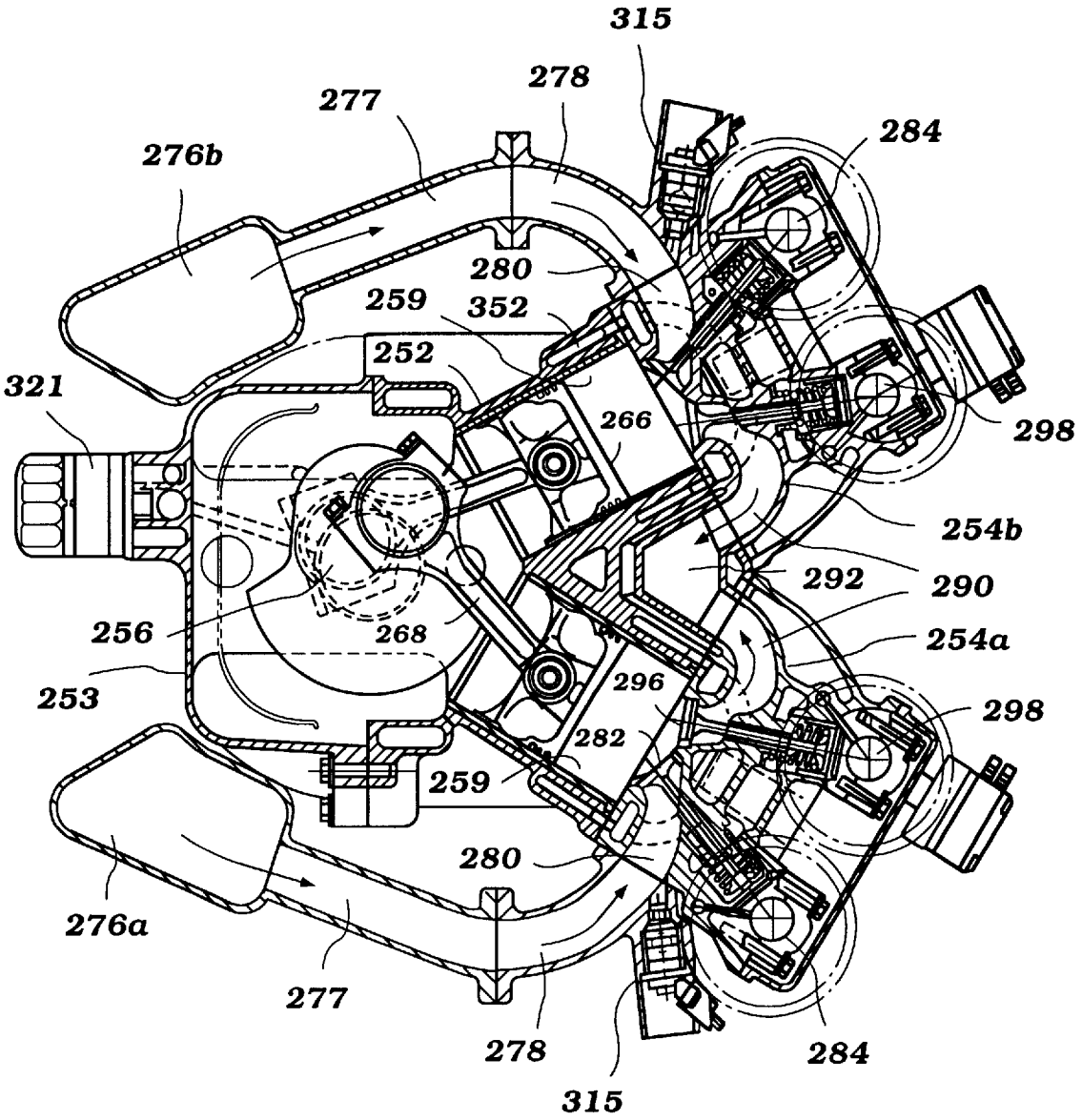
FIG. 15 is a top, cross-sectional view of the engine illustrated in FIG. 12.
Figure 16:
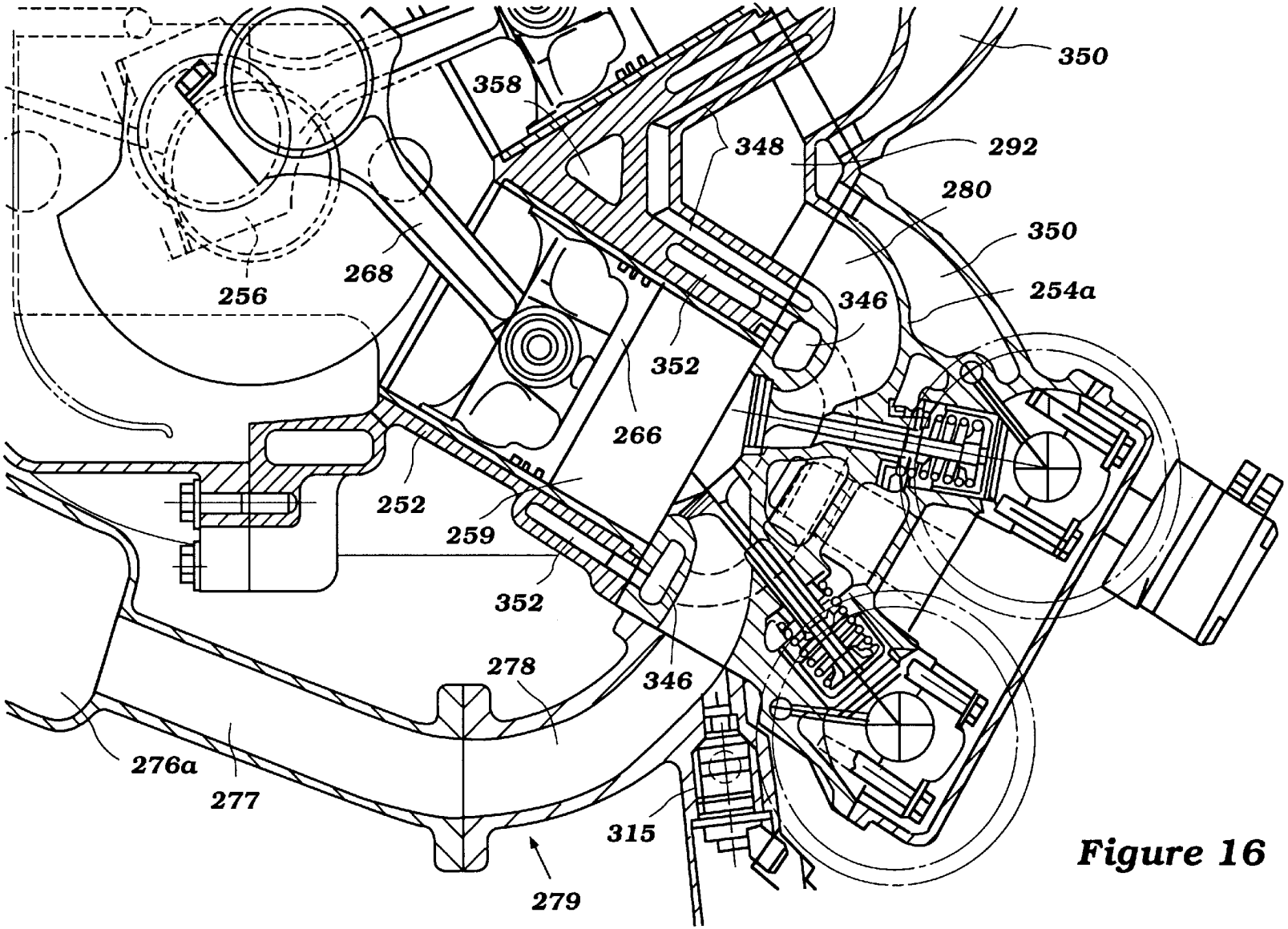
FIG. 16 is an enlarged view of that portion of the engine illustrating the cooling arrangement for the exhaust manifold of the engine illustrated in FIG. 13.

As illustrated in more detail in FIGS. 15 and 16, the exhaust manifold is preferably formed integrally with the cylinder block 252. In this arrangement, the common exhaust passage 292 is simply a passage extending generally vertically through a portion of the cylinder block 252 located in the valley between the cylinder banks.

As best illustrated in FIG. 13, an exhaust guide 322 is positioned at the bottom end of the engine 222. The exhaust guide 322 has a passage 324 extending therethrough which is aligned with the passage 292 at its top side. An exhaust pipe 326 is connected to the bottom side of the exhaust guide 322 in alignment with the passage 324. The exhaust pipe 326 terminates within a chamber of a muffler 328.

The muffler 328 is positioned within the lower unit 38 and between the drive shaft 260 and a cooling water return. An exhaust gas outlet 330 is provided in the bottom end of the muffler 328, through which the exhaust gas is routed to a point external of the motor 20.

A cooling system is provided for cooling the engine 222. More particularly, and in accordance with the present invention, the cooling system serves to cool the exhaust manifold area 294 of the engine, to prevent the transmission of heat from the exhausted gases through the walls defining the passage 292 to the combustion chambers 259.

First, cooling water is pumped by a water pump 342 positioned in the lower unit 34 from the body of water in which the motor 222 is positioned. The pump 342 is preferably driven by the drive shaft 260, and expels the cooling water upwardly through a cooling water delivery pipe 344. This coolant passes into a number of cooling water passages throughout the cylinder block 252 and heads 254*a,b*. As best illustrated in FIGS. 15 and 16, the pipe 344 leads to a generally "V" shaped passage 348 positioned between the common exhaust passage 292 and the combustion chambers 292 in each bank. After passing through passage 348, the coolant is routed into a pair of passages 350, one passage 350 each positioned in one of the cylinder heads 254*a,b* adjacent the exhaust passages 290 therethrough.

Figure 19:
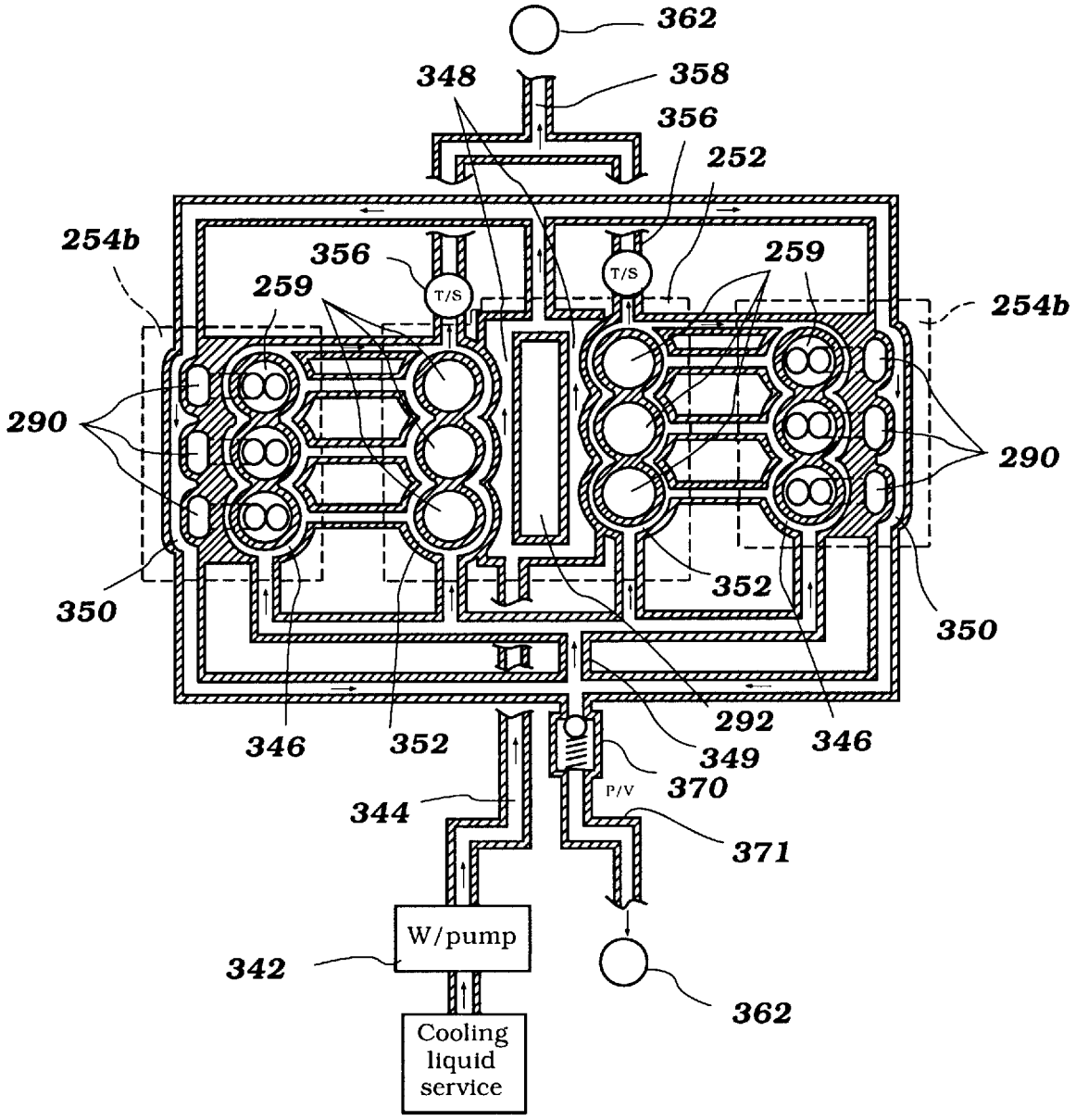
FIG. 19 is a schematic view illustrating a liquid cooling system in accordance with the present invention of the engine illustrated in FIG. 12.

As best illustrated in FIG. 19, the cooling water passages 350 rejoin at a passage 349 where there is positioned a pressure relief valve 370, described in more detail below. The coolant which is not diverted by the valve 370 passes into passages 346 in each cylinder head 254*a,b* adjacent the combustion chambers 259, as well as passages 352 (in communication with passages 346) in the cylinder block 252 about the combustion chambers. Notably, the passages 346, 352 take the form of jackets which generally surround the respective portions of the combustion chambers 259 formed in the cylinder block 252 and heads 254*a,b*. Thereafter, the cooling water passes into a generally vertically extending return passage 358 extending through the cylinder block 252, for draining the coolant to the bottom of the engine 222. The return passage 358 is preferably positioned between the passage 348 and the combustion chambers 259, in the valley between the cylinder banks.

A thermostat is 356 provided at the end of the passage 352 corresponding to each bank, and before the cooling water enters the return passage 358, for controlling the flow of cooling water through the heads and block. The cooling water return passage 358 extends through the block 252 to a connecting passage 360 which leads into the lower unit 34 to a cooling water pool or chamber 362. This chamber 362 extends about the muffler 328, oil reservoir 318 and the like. When the water lever in the chamber 362 becomes to high, the cooling water runs over an overflow ledge 364 to a passage 366 leading to a drain 368. The cooling water diverted to the drain 368 is discharged from the motor.

In that instance where the pressure of the cooling water within the cooling water passages becomes too high, a pressure relief valve 370 diverts cooling water a relief line 371 which extends through the exhaust guide to the chamber 362.

The liquid cooling arrangement of the present invention as described in conjunction with the engine 222 has similar advantages to the liquid cooling arrangement described above in conjunction with the engine 22, and as illustrated in FIG. 9. In particular, the cooling water is first routed through cooling passages 348,350 for cooling the exhaust passages, and then to the passages 352,356 for cooling the combustion chambers 259. In this manner, the cooling water is of relatively uniform temperature when it reaches the passages adjacent the combustion chambers. In addition, cold cooling water is not introduced into the passages adjacent the combustion chambers, since the cooling water must pass through the passages 348,350 where it is heated by the exhaust gases.

Figure 14:
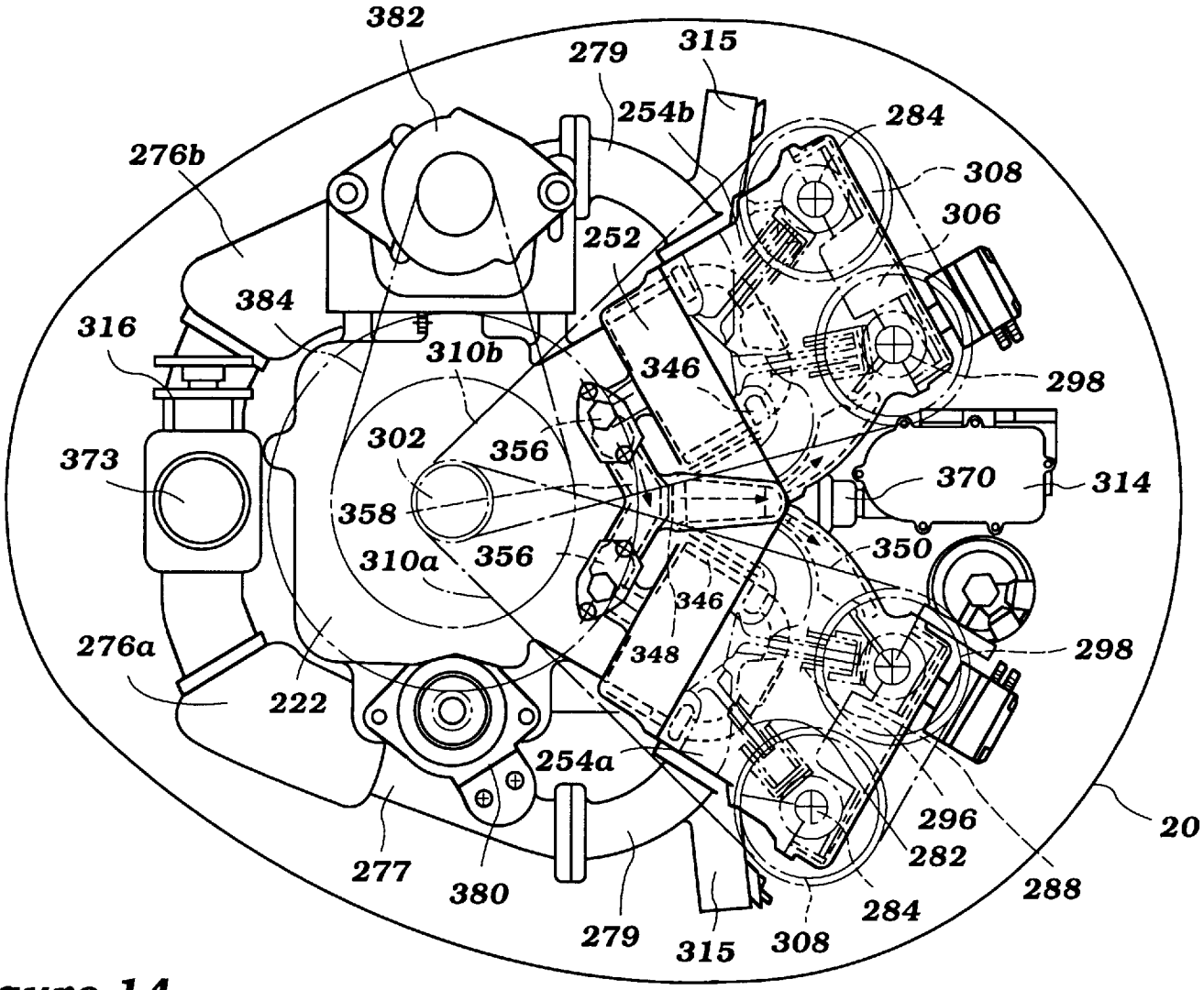
FIG. 14 is a top view of the engine illustrated in FIG. 12.

As illustrated in FIG. 14, the engine 222 may also include a starter 380 which selectively engages the flywheel 304 for use in starting the engine. In addition, the engine 222 may include an alternator 382 which is driven by the crankshaft 256 by a belt 384. These and other engine accessories may be provided as well known to those skilled in the art. While reference has been made to the use of water as the coolant in the cooling systems of the present invention, it should be understood that a variety of other liquids may be utilized in the cooling system(s) of the present invention.

Of course, the foregoing description is that of preferred embodiments of the invention, and various changes and modifications may be made without departing from the spirit and scope of the invention, as defined by the appended claims.

What is claimed is:

1. An internal combustion engine having a liquid cooling system, said engine comprising a cylinder block having at least one cylinder head connected thereto and defining a combustion chamber, a common exhaust passage extending through said cylinder block, and an exhaust passage leading through said head from each combustion chamber to said common exhaust passage, and wherein said liquid cooling system comprises at least one first cooling passage extending through said head adjacent said exhaust passages leading from said combustion chambers, at least one second cooling passage extending through said cylinder block adjacent said common exhaust passage, one or more combustion chamber cooling passages extending through said cylinder head and block adjacent said combustion chambers, a cooling liquid source, means for pumping liquid from said source for delivery through said at least one first and second cooling passages before delivering said cooling liquid to said combustion chamber cooling passages and further including a pressure relief valve positioned along said cooling path after said first and second cooling passages and before said combustion chamber cooling passages.

2. The internal combustion engine in accordance with claim 1, wherein said cooling liquid is delivered first to said at least one first cooling passage, then to said at least one second cooling passage, and then through said combustion chamber cooling passages.

3. The internal combustion engine in accordance with claim 1, wherein said cooling liquid is delivered first to said at least one second cooling passage, then to said at least one first passage, and then through said combustion chamber cooling passages.

4. The internal combustion engine in accordance with claim 1, further including a cooling water return line and a thermostat for controlling the flow of cooling liquid to said line from said combustion chamber cooling passages.

5. The internal combustion engine in accordance with claim 1, wherein a pressure relief line extends from said pressure relief valve for diverting cooling liquid from said passages in said engine to a point exterior thereof.

6. The internal combustion engine in accordance with claim 1, wherein said engine is of the inline variety and said common exhaust passage is generally vertically extending and said combustion chambers are vertically arranged, and wherein said at least one first and second passages are generally vertically extending.

7. The internal combustion engine in accordance with claim 6, further including a generally vertically extending cooling liquid return line and a thermostat positioned at a top end of said engine for controlling the flow of cooling liquid from said combustion chamber cooling passages to said cooling liquid return line.

8. The internal combustion engine in accordance with claim 6, wherein a pair of second cooling passages are positioned within said cylinder head.

9. The internal combustion engine in accordance with claim 1, wherein said engine is of the "V"-type, said cylinder block defining a first bank and a second bank with a valley therebetween, and wherein a first cylinder head is connected to said cylinder block for defining one or more combustion chambers of said first bank, and a second cylinder head is connected to said cylinder block for defining one or more combustion chambers of said second bank.

10. The internal combustion engine in accordance with claim 9, wherein said common exhaust passage extends through said cylinder block between said banks and said at least one second passage extends through said cylinder block between said common exhaust passage and said combustion chambers in said first and second banks.

11. The internal combustion engine in accordance with claim 9, wherein at least one first passage extends through each of said first and second cylinder heads.

12. The internal combustion engine in accordance with claim 10, further including a cooling liquid return line, said line extending through said valley of said cylinder block.

13. The internal combustion engine in accordance with claim 10, wherein said at least one first and second passages and said cooling liquid return line are generally vertically extending and further including at least one thermostat positioned at a top end of said engine for controlling the passage of cooling liquid from said combustion chamber cooling passages to said return line.

14. The internal combustion engine in accordance with claim 10, wherein at least one of said combustion chamber cooling passages within said cylinder block is positioned between said combustion chambers and said second passage.

15. The internal combustion engine in accordance with claim 1, wherein one second cooling passage is provided adjacent said common exhaust passage for cooling primarily only the area of said cylinder block adjacent said common exhaust passage, and wherein said coolant is routed from said passage to said at least one first passage in said cylinder head before being delivered into said at least one combustion chamber cooling passage in said cylinder block for cooling primarily the portion of said cylinder block adjacent said combustion chambers.

16. A method of supplying cooling liquid to an internal combustion engine, said engine comprising a cylinder block having at least one cylinder head connected thereto and defining at least one combustion chamber therein, a common exhaust passage leading through said cylinder block, an exhaust passage leading from each combustion chamber to said common exhaust passage, comprising the steps of: delivering cooling liquid to at least one passage extending through said cylinder head adjacent said exhaust passages leading from said combustion chambers, delivering said cooling liquid to at least one passage extending through said cylinder block adjacent said common exhaust passage, and after said delivering of said cooling liquid to said passages extending through said cylinder head and block, delivering said cooling liquid to one or more passages in said cylinder block or head adjacent said combustion chamber and further including the step of diverting at least a portion of said cooling liquid passing through said passages extending through said cylinder head and block and preventing said diverted cooling liquid from passing through said passage through said passages in said cylinder block or head adjacent said combustion chamber in the event a cooling liquid pressure within said passages in said cylinder block or head adjacent said combustion chamber exceeds a predetermined pressure.

17. The method in accordance with claim 16, wherein said cooling liquid is first delivered to said at least one passage extending through said cylinder block adjacent said common exhaust passage for cooling primarily that portion of the cylinder block adjacent said passage, and then delivered to said at least one passage extending through said cylinder head adjacent said exhaust passages, and then delivered to said passages in said cylinder block and head for cooling said areas thereof adjacent said combustion chamber.

18. The method in accordance with claim 16, wherein said cooling liquid is first delivered to said at least one passage extending through said cylinder head adjacent said exhaust passages, and then delivered to said at least one passage extending through said cylinder block adjacent said common exhaust passage.

19. The method in accordance with claim 16, further comprising the step of draining said cooling liquid from said engine through a return line after said cooling liquid is delivered to said at least one passage extending through said cylinder block or head adjacent said combustion chamber.

20. The method in accordance with claim 17, further including the step of controlling the flow of cooling liquid from said at least one passage adjacent said combustion chamber to said return line with a thermostat.

* * * * *